US010993566B2

(12) United States Patent
Karelis et al.

(10) Patent No.: US 10,993,566 B2
(45) Date of Patent: May 4, 2021

(54) MULTI-POSITION HANGERS AND RELATED METHODS

(71) Applicants: Charles Howard Karelis, North Chatham, NY (US); Alexander Oliver Karelis, Philadelphia, PA (US)

(72) Inventors: Charles Howard Karelis, North Chatham, NY (US); Alexander Oliver Karelis, Philadelphia, PA (US)

( * ) Notice: Subject to any disclaimer, the term of this patent is extended or adjusted under 35 U.S.C. 154(b) by 0 days.

(21) Appl. No.: 16/590,374

(22) Filed: Oct. 1, 2019

(65) Prior Publication Data

US 2020/0100612 A1 Apr. 2, 2020

Related U.S. Application Data

(63) Continuation-in-part of application No. 15/468,947, filed on Mar. 24, 2017, now Pat. No. 10,426,283.

(60) Provisional application No. 62/312,559, filed on Mar. 24, 2016.

(51) Int. Cl.

| | |
|---|---|
| ***A47G 25/16*** | (2006.01) |
| ***A47G 25/32*** | (2006.01) |
| ***A47G 25/20*** | (2006.01) |

(52) U.S. Cl.
CPC ..... *A47G 25/16* (2013.01); *A47G 25/20* (2013.01); *A47G 25/32* (2013.01)

(58) Field of Classification Search
CPC ..... A47G 25/16; A47G 25/20; A47G 25/32; A47G 25/28; A47G 25/38
See application file for complete search history.

(56) References Cited

U.S. PATENT DOCUMENTS

| | | | |
|---|---|---|---|
| 1,867,614 | A | 7/1932 | Cuscaden |
| 2,185,253 | A | 1/1940 | Klein |
| 2,512,133 | A | 6/1950 | Baer |
| 2,634,032 | A | 4/1953 | Bartlett |
| 2,685,991 | A | 8/1954 | Goza et al. |
| 3,651,999 | A | 3/1972 | Fiocca |

(Continued)

OTHER PUBLICATIONS

Amazon.com: "Suit and Trouser/Pants Clothes Hanger With Clips"; https://www.amazon.com/gp/product/B00W4G4OYA/ref=oh_aui_detailpage_o00_s00?ie=UTF8&psc=1; Available at least as early as Jul. 3, 2015 (based on the first customer review on p. 6).

*Primary Examiner* — Nathan E Durham
(74) *Attorney, Agent, or Firm* — Heslin Rothenberg Farley & Mesiti P.C.; Kristian E. Ziegler, Esq.

(57) ABSTRACT

A multi-position hanger is disclosed. The hanger comprises a hook member with a hook portion and a stem portion, a wishbone rotatably attached to the stem portion, and a pants bar rigidly attached to the wishbone. The wishbone comprises first and second arms and a hook-shaped slot defining first and second end surfaces facing a front lateral face of the wishbone. The stem portion of the hook member extends through and is translatable within the hook-shaped slot. The wishbone and the pants bar are selectively repositionable with respect to the hook member when the hook portion hangs on a support between a kick out orientation of the hanger with the pants bar positioned at a first lateral position with respect to a centerline extending vertically downward from the wishbone, and a nested orientation with the pants bar positioned at a second lateral position with respect to the centerline.

19 Claims, 38 Drawing Sheets

(56) References Cited

U.S. PATENT DOCUMENTS

| | | | | |
|---|---|---|---|---|
| 3,860,154 | A * | 1/1975 | Atkins | A47G 25/183 223/88 |
| 3,935,976 | A | 2/1976 | Mizrach | |
| 4,728,016 | A | 3/1988 | McPhee | |
| 5,085,357 | A | 2/1992 | Chen | |
| 5,645,200 | A | 7/1997 | McDowell et al. | |
| 6,126,049 | A | 10/2000 | Gish | |
| 6,213,359 | B1 | 4/2001 | Gish | |
| 6,962,276 | B2 | 11/2005 | Fradkin | |
| D546,568 | S | 7/2007 | Foreman | |
| 9,113,736 | B1 | 8/2015 | Antler | |
| 9,492,025 | B1 * | 11/2016 | Wu | A47G 25/20 |
| 2004/0026469 | A1 | 2/2004 | Grasso et al. | |
| 2005/0061839 | A1 | 3/2005 | Fradkin | |

* cited by examiner

MULTI-POSITION HANGERS AND RELATED METHODS

CROSS-REFERENCE TO RELATED APPLICATIONS

This application is a continuation-in-part of U.S. patent application Ser. No. 15/468,947, filed Mar. 24, 2017, and entitled Multi-Position Suit Hanger System and Method, which claims priority benefit to U.S. Provisional Patent Application No. 62/312,559, filed Mar. 24, 2016, the entire contents of which are hereby incorporated herein by reference.

TECHNICAL FIELD

Various embodiments described herein relate to a multi-position hanger system and a method for using the same.

BACKGROUND

Hangers for clothes are ubiquitous. They populate closets throughout the world and are used to keep people's clothes neat and organized. Some hangers are specialized and used to hang expensive and important clothes, such as a suit of clothes. A suit of clothes typically includes a set of pants and a coat. It is important to hang a suit properly so as to minimize wrinkles and to keep the suit clean.

One problem associated with hanging suits occurs when dressing or undressing. The typical hanger for suits includes a hanger having two arms. A pants bar is connected between the bottoms and/or ends two arms of the hanger, and may or may not have a mechanism for holding the pants in place. When dressing, the suit coat must be removed from the hanger and set aside, which may wrinkle and/or dirty the coat. The pants can then be removed from the pants bar and put on, and then the coat can be picked from its temporary resting spot and put on. When undressing at the end of the day, the suit coat must be removed and set aside, which may wrinkle and/or dirty the coat. The coat can typically only be placed on the hanger after the pants have been placed onto the pants bar as the coat prevents or interferes with use of the pants bar.

A hanger that is configured to hang both at least one pair of pants and at least one coat (e.g., at least one suit), and allows the pants to be removed from, and re-rehung on, the hanger prior to that of the coat, would be desirable.

SUMMARY

The multi-position hanger of the present disclosure allows a user to easily remove a jacket/shirt and a pair of pants from the hanger in the order they are typically worn/put on when dressing (the pants prior to the jacket/shirt), and to easily hang up a jacket/shirt and a pair of pants in the order they are typically taken of when undressing (the jacket/shirt prior to the pants). The multi-position hanger of the present disclosure thereby eliminates the putting aside of a jacket/shirt while dressing and undressing, as is typically necessary with prior hangers. aside Thereby, the multi-position hanger of the present disclosure saves wearers steps, and the chance that the jacket/shirt becomes wrinkled and/or dirty, while both dressing and undressing. This can easily happen when a jacket/shirt is put aside for any length of time, such as when a suit-wearer removes his or her jacket at the end of a work day, hours before undressing for bed. These are just a few of the benefits of the multi-position hanger of the present disclosure for suit (e.g., jacket/shirt and a pair of pants) wearers or owners. More benefits will be evident as the various embodiments are further described below.

To get these two benefits, people have sometimes used standing wooden "valets," and they have sometimes hung their suit jackets and pants on separate hangers.

The multi-position hanger of the present disclosure has advantages over both. The multi-position hanger of the present disclosure takes up a fraction of the space of a standing valet unit, indeed no floor-space at all. The multi-position hanger of the present disclosure also makes it easy to keep jackets and matching trousers together. Keeping the pieces of a suit from getting separated in the closet is beneficial. Another advantage over using two hangers is that the multi-position hanger of the present disclosure takes up less lateral closet space. A third advantage over using two hangers is that the zippered garment bags used for storing and transporting suits have only small holes at the top for the hooks of hangers, which tend to tear when multiple hooks are stuck through them. Further, hanging hooks for hangers are typically configured to accommodate only one hanger.

In addition, the multi-position hanger of the present disclosure and its embodiments will benefit clothing salespeople, who hang and unhang jackets/shirts and pants repeatedly.

In one aspect, the present disclosure provides a multi-position hanger comprising, a hook member comprising a hook portion and a stem portion, a wishbone rotatably attached to the stem portion of the hook member, and a pants bar rigidly attached to the wishbone positioned below the wishbone and defining a free end. The wishbone comprises a first arm that defines a first free end, an opposing second arm that defines a second free end, and a hook-shaped slot defining first and second end surfaces facing a front lateral face of the wishbone. The stem portion of the hook member extends through and is translatable within the hook-shaped slot of the wishbone. The wishbone and the pants bar are selectively repositionable with respect to the hook member when the hook portion hangs on a support between a kick out orientation of the hanger with the pants bar positioned at a first lateral position with respect to a centerline extending vertically downward from the wishbone and the stem portion being positioned against the first end surface of the hook-shaped slot to retain the kick out orientation, and a nested orientation of the hanger with the pants bar positioned at a second lateral position with respect to the centerline, the first and second lateral positions being differing lateral positions with respect to the centerline.

In some embodiments, in the nested orientation of the hanger, the stem portion is positioned against the second end surface of the hook-shaped slot to retain the nested orientation. In some embodiments, the wishbone is positioned fully below the hook portion of the hook member when the pants bar is in the kick out and nested orientations. In some embodiments, the wishbone and the pants bar are rotatable about an axis of the stem portion of the hook member. In some embodiments, the wishbone and the pants bar are angularly adjustable with respect to the axis of the stem portion of the hook member.

In some embodiments, the stem portion comprises a spherical end portion and the wishbone comprises a socket portion, the spherical end portion and the socket portion being rotatably coupled together and forming a ball-and-socket joint. In some embodiments, the stem portion and the wishbone are rotatably within an interior cavity of the wishbone. In some embodiments, the stem portion and the wishbone are rotatably coupled below the hooked-shaped slot.

In some embodiments, the first end surface of the hooked-shaped slot is positioned proximate to a first lateral side and distal to second lateral side of the wishbone, and the second end surface of the hooked-shaped slot is positioned proximate to the second lateral side and distal to first lateral side of the wishbone. In some embodiments, the hooked-shaped slot comprises a linear portion that extends along the lateral direction from the second end surface thereof, and an arcuate portion that extends from the first end surface thereof to the linear portion. In some such embodiments, the arcuate portion extends laterally and along a longitudinal direction that extends between the first and second free ends of the wishbone.

In some embodiments, the second lateral position of the pants bar is laterally aligned with the centerline. In some embodiments, the second lateral position of the pants bar is laterally spaced from the centerline.

In some embodiments, the pants bar extends linearly. In some embodiments, the stem portion extends linearly. In some embodiments, the hanger further comprises a sleeve extending over the pants bar. In some embodiments, the hanger further comprises an offset bar that extends between the wishbone and an end of the pants bar that opposes the free end thereof. In some embodiments, the hanger further comprises a second pants bar fixedly coupled to and positioned below the first pants bar.

In some embodiments, a first lateral side of the hook member and the pants bar form a first angle therebetween, and wherein the first angle is smaller in the kick out orientation of the hanger than in the nested orientation of the hanger. In some embodiments, a first lateral side of the hook member and the wishbone form a first angle therebetween, and wherein the first angle is smaller in the kick out orientation of the hanger than in the nested orientation of the hanger.

It should be appreciated that all combinations of the foregoing aspects and additional concepts discussed in greater detail below (provided such concepts are not mutually inconsistent) are contemplated as being part of the inventive subject matter and to achieve the advantages disclosed herein.

BRIEF DESCRIPTION OF THE DRAWINGS

These and other features, aspects, and advantages of the present disclosure will become better understood when the following detailed description is read with reference to the accompanying drawings, which are not necessarily drawn to scale and in which like reference numerals represent like aspects throughout the drawings, wherein.

DETAILED DESCRIPTION

Figure 1:
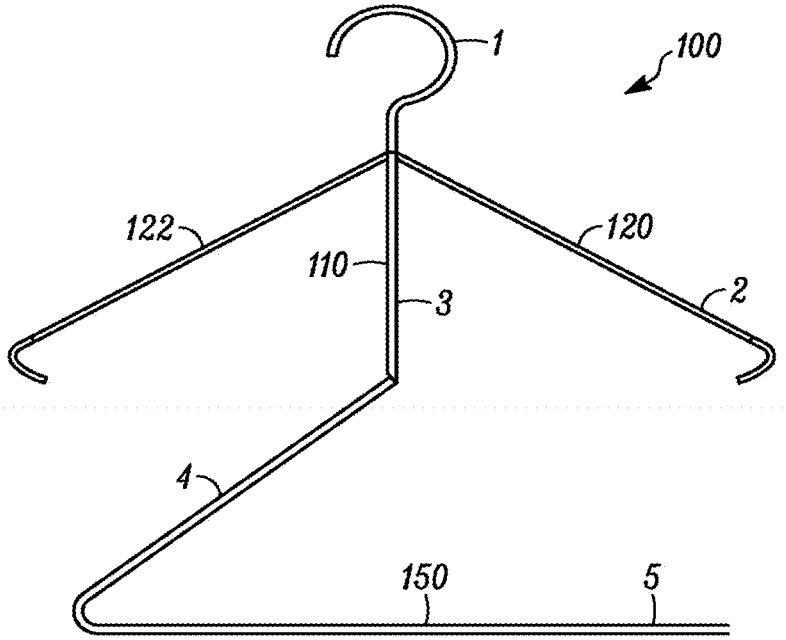
FIG. 1 is a front view of a multi-position hanger, according to an exemplary embodiment of present disclosure.

Aspects of the present disclosure and certain examples, features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the disclosure, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the approximating language may correspond to the precision of an instrument for measuring the value.

Terminology used herein is for the purpose of describing particular examples only and is not intended to be limiting. As used herein, the singular forms "a", "an" and "the" are intended to include the plural forms as well, unless the context clearly indicates otherwise. Furthermore, references to "one example" are not intended to be interpreted as excluding the existence of additional examples that also incorporate the recited features. Moreover, unless explicitly stated to the contrary, the terms "comprising" (and any form of "comprise," such as "comprises" and "comprising"), "have" (and any form of "have," such as "has" and "having"), "include" (and any form of "include," such as "includes" and "including"), and "contain" (and any form of "contain," such as "contains" and "containing") are used as open-ended linking verbs. As a result, any examples that "comprises," "has," "includes" or "contains" one or more step or element possesses such one or more step or element, but is not limited to possessing only such one or more step or element. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

Figure 2:
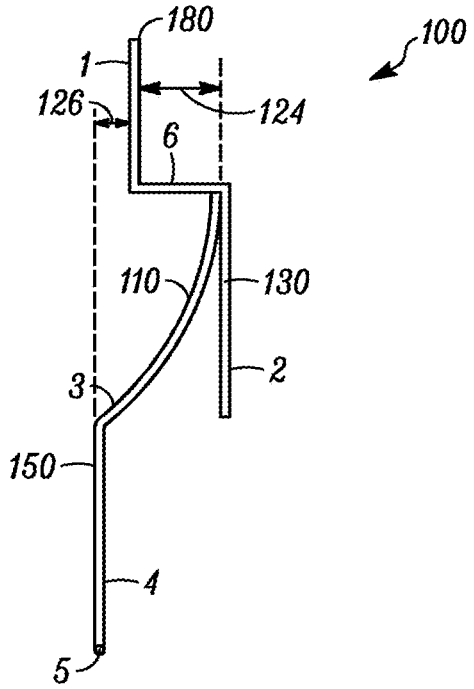
FIG. 2 is a side view of a multi-position hanger, according to an exemplary embodiment of present disclosure.
Figure 3:
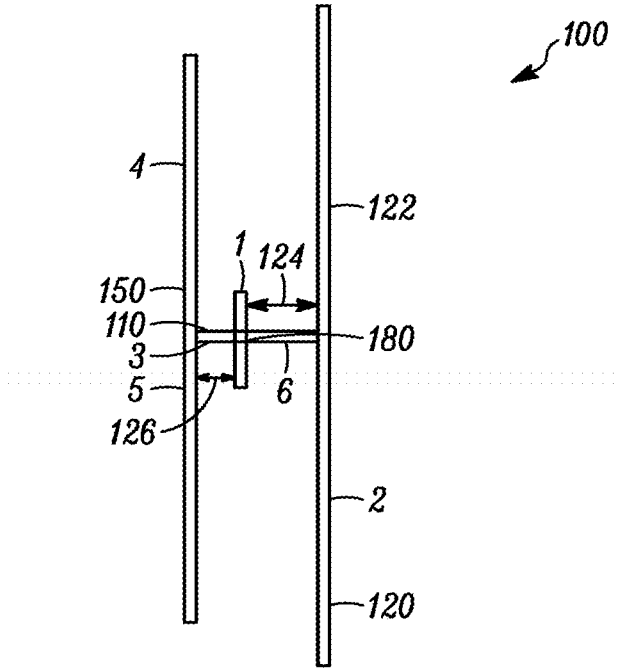
FIG. 3 is a top view of a multi-position hanger, according to an exemplary embodiment of present disclosure.
Figure 4:
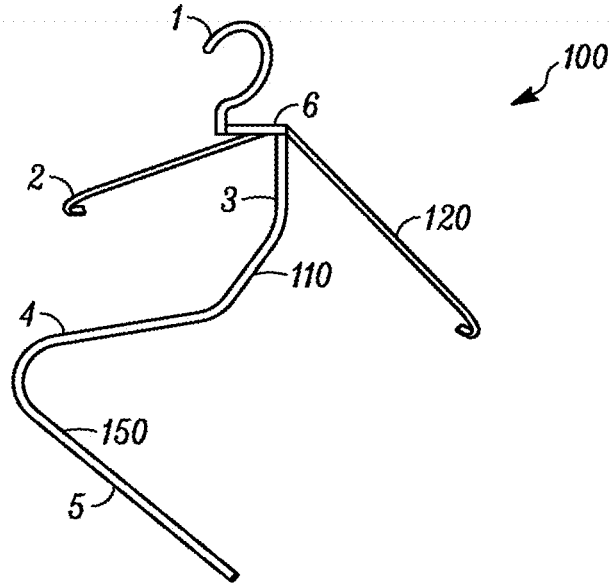
FIG. 4 is a perspective view of a multi-position hanger, according to an exemplary embodiment of present disclosure.

FIGS. 1-6 show one example embodiment of the suit hanger 100. Now referring to FIGS. 1-4, the suit hanger will be more fully described. FIG. 1 is a front view of a multi-position hanger, according to an exemplary embodiment of present disclosure. FIG. 2 is a side view of a multi-position hanger, according to an exemplary embodiment of present disclosure. FIG. 3 is a top view of a multi-position hanger, according to an exemplary embodiment of present disclosure. FIG. 4 is a perspective view of a multi-position hanger, according to an exemplary embodiment of present disclosure. The suit hanger 100 includes a main body 110. The main body 110 is curved. In this particular embodiment, the curved main body is in the form of a swoosh 3. Attached the top of the main body 110 is a question mark hook 1. A hook offset bar 6 has one end attached to the main body 110 and another end attached to the question mark-shaped hook 1. Also attached to the main body is a wishbone 2. The wishbone has a first arm 120 and a second arm 122. The first arm 120 and the second arm 122 are formed to receive a jacket or suitcoat (shown in FIGS. 5 and 6). The wishbone 2 is attached an end of the body 110 closest to the question mark hook 1. A pants hanger 150 is attached to the other end of the main body 110 of the suit hanger 100. The pants hanger 150 is an open jaw type hanger and includes an open jaw connector bar 4 and a pants hanger bar 5 connected to the open jaw connector bar 4. The pants hanger bar 5 is generally horizontal during use.

It should be noted that the bar 6 is not perfectly horizontal at all times during the operation of the hanger 100. When the hanger 100 is loaded, the bar 6 is more horizontal than when the hanger 100 is unloaded. This will be discussed in further detail below.

The hanger 100 also includes a pivot point 180 which is somewhere along the surface of the question mark hook 1. The pivot point 180 is at or near the contact point of the question mark hook 1 when it hangs on a closet rod or the like (not shown). It should be noted that the pivot point 180 shifts or moves along the surface of the question mark hook 1 as the hanger 100 is loaded with a coat or jacket on the wishbone 2, and then again when the pants are placed on the pants bar 5. The pivot point 180 shown in FIGS. 2 and 3 is for the sake of illustration and generally will move.

In addition, it should be noted that question mark hook 1 is offset a distance 124 from the arms 120, 122 of the wishbone 2. In addition, the question mark hook 1 is offset a distance 126 from the pants bar 5 of the pants hanger 150. Given the fact that the pivot point is on the question mark hook 1, one can see that the offset distance 124 is a moment arm for producing a moment (force at a distance) when a suit coat or jacket (shown in FIGS. 5 and 6) is loaded or placed onto the wishbone 1. This causes a clockwise moment about a pivot point on the question mark hook 1. Similarly, that the offset distance 126 is a moment arm for producing a moment (force at a distance) when pants (shown in FIGS. 5 and 6) are loaded or placed onto the pants bar 5. Loading the pants bar 5 with pants increases a counter clockwise moment about the pivot point 180.

Figure 5:
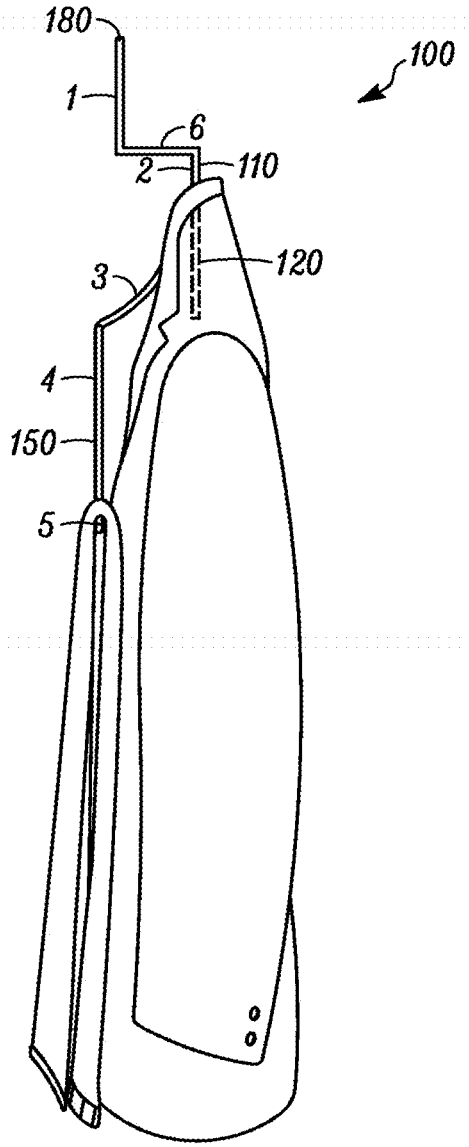
FIG. 5 is a side view of a multi-position hanger in a fully nested position, according to an exemplary embodiment of present disclosure.
Figure 6:
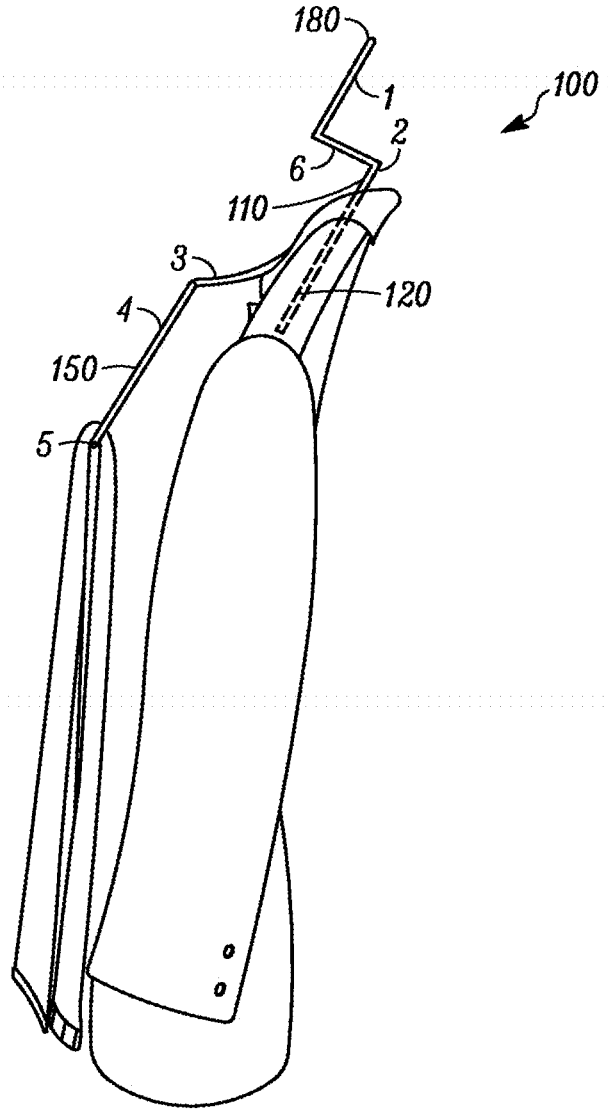
FIG. 6 is a side view of a multi-position hanger in a kicked out position just before loading the pants bar 5 with a set of pants, according to an exemplary embodiment of present disclosure.

Now turning to FIGS. 5 and 6, the operation of the hanger will be more fully described. FIG. 6 is a side view of a multi-position hanger in a kicked out position just before loading the pants bar 5 with a set of pants, according to an exemplary embodiment of present disclosure.

FIG. 6 when the coat is hung on the wishbone 2, the increased clockwise moment about the pivot point 180 moves the pants bar 5 out away from the pivot 180 of the hanger. In this kick out position, the effect is like the pants bar 5 being presented to the user to invite the user to place the pants on the pants bar 5. Again, FIG. 6 shows the hanger 100 before the counter clockwise moment produced by loading the pants onto the pants bar 5 has taken effect. In other words, the pants are either hovering over the pants bar 5 or have just initially been placed on the pants bar 5.

The loading of the pants onto the pants bar 5 produces a counter clockwise moment that acts to move the entire hanger 100 to the position shown in FIG. 6. In the position shown in FIG. 6, the hanger 100 presents a slimmer profile when compared to the kick out position shown in FIG. 6. Basically, the open jaw connector bar 4 in FIG. 6 is now closer to a vertical position so that the hanger 100 with the suit hanging on it presents a slimmer profile or width when hanging on the closet rod. FIG. 6 represents the final resting position of the suit as hung on the hanger 100 on a closet rod in a closet.

FIG. 5 is a side view of a multi-position hanger in a fully nested position, according to an exemplary embodiment of present disclosure. FIG. 6 is a side view of a multi-position hanger in a before being fully loaded, according to an exemplary embodiment of present disclosure. FIG. 6 is the view from the side with jacket hung on wishbone, which is 2, and pants draped over the substantially horizontal pants bar 5. In this FIG. 6, the hanger is shown just before the force of gravity swings the substantially horizontal pants bar 5 down, bringing pants snug up against the jacket, as shown in FIG. 5.

The wishbone, 2, is held in the right hand and the jacket in the left hand. (This assumes a right-handed user.) The left-hand wing of the wishbone is slipped into the left shoulder of the jacket, and the hanger is held through the jacket fabric. Then using the right hand, the right-hand wing of the wishbone is slipped into the right shoulder of the jacket. The wishbone may be tilted slightly to make the clearance between the jacket and the horizontal pants bar bigger. Then the hanger is hung up with only the jacket hung on the hanger and not the pants. Due to the offsetting of the hook, 1, shown in FIG. 2, the weight of the jacket automatically kicks out the substantially horizontal pants bar, 5. This makes it easy to drape the pants over the bar 5, as shown in FIG. 6. The weight of the pants then swings the bar, 5, down into the position shown in FIG. 5. The pieces of the suit have been hung up in the natural order.

In another embodiment of the multi-position hanger of the present disclosure, the tubing that constitutes the wishbone, 2, is replaced by a hollow molded plastic wishbone, which is rounded at the ends to improve the draping of the jacket when hung up. In a further refinement of this embodiment, the molded wishbone is enabled to rock backwards and forwards, without twisting. This is achieved by the presence of a small cylinder which is attached to the hook offset bar 6, just at the point where it meets the swoosh, 3, and which fits up inside a half cylindrical housing in the underside of the hollowed out molded plastic wishbone 2. The opening in the wishbone 2 through which the tubing goes would have to be enlarged into a slot running back to front to allow this rocking to occur. By this means the suit jacket can hang absolutely straight even when the open jaw pants hanger, 4, is kicked out, as in FIG. 6.

With respect to balance, the multi-position hanger of the present disclosure has a number of alternative embodiments conforming to the following rule or principle. Let n be the multiple that the length of the hook offset bar, 6, is of the length of the swoosh, 3, as seen from above as in FIG. 3. This ratio could be 1:1 or 2:1 and so on. In the initially described example embodiment described above, that ratio is 2:1. However it could be 1:1 if the objective of minimizing lateral space taken up by the loaded hanger were given up. Then the rule is this. The weight of the wishbone, 2, plus the weight of the jacket times n must equal the weight of the pants plus the weight of the horizontal bar, 5.

Another alternative embodiment would be to make the hanger from some rigid material other than metal tubing, such as thick wire or plastic. Still another embodiment would be to enhance the rigidity of the whole hanger by "completing" one or both of the open triangular shapes, the wishbone or the open jaw pants hanger, by adding a third side.

Another embodiment would be to make the hook opening, in the question mark hook, 1, elliptical rather than round, to allow the hook to tip over enough when only the jacket is on the hanger.

Figure 7:
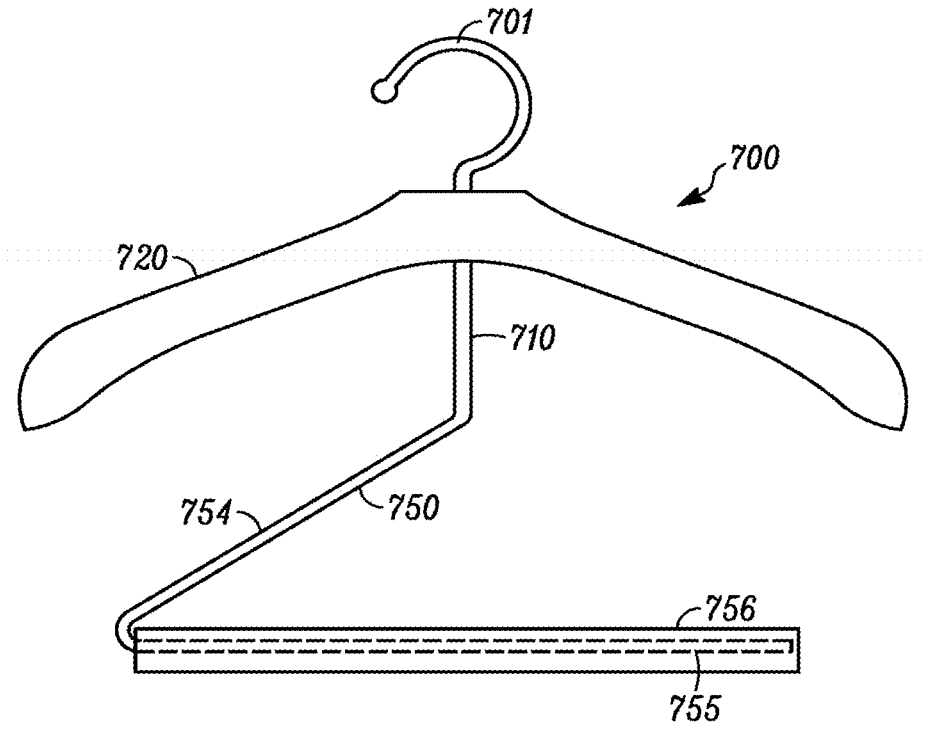
FIG. 7 front view of a multi-position hanger, according to an exemplary embodiment of present disclosure.
Figure 8:
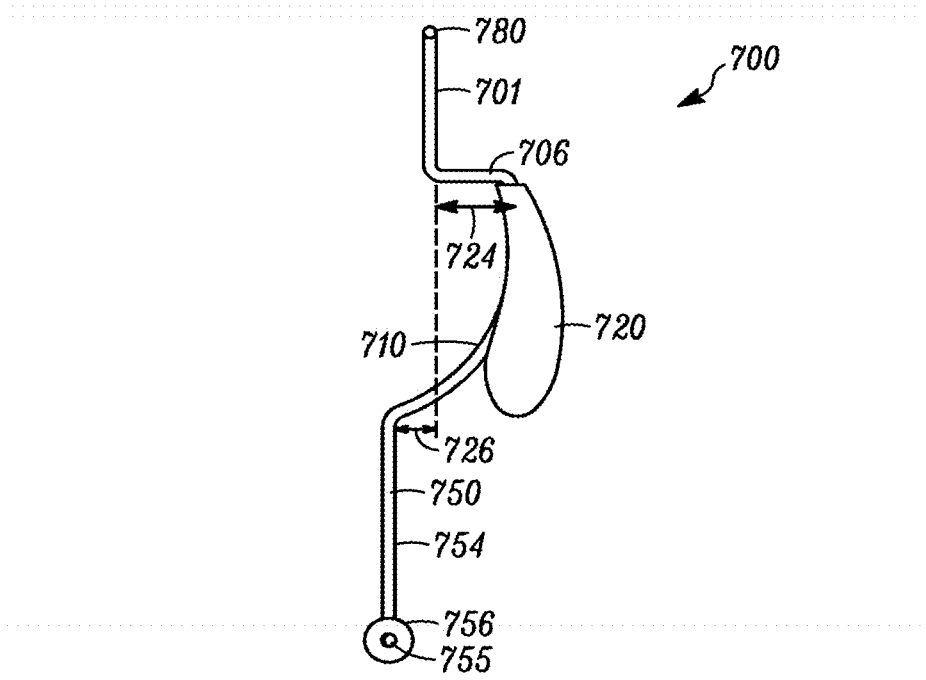
FIG. 8 is a side view of a multi-position hanger, according to an exemplary embodiment of present disclosure.
Figure 9:
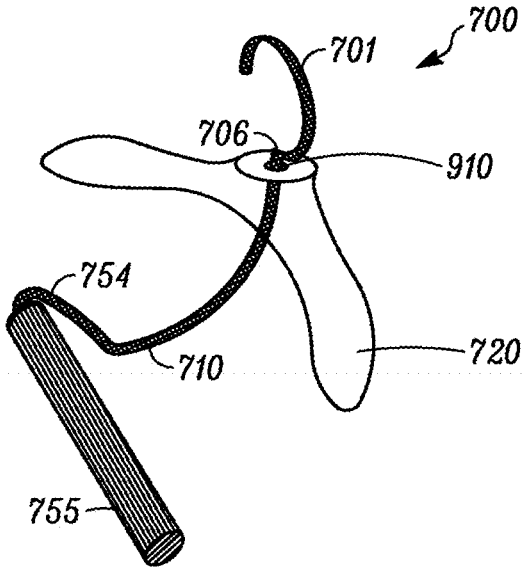
FIG. 9 perspective view of a multi-position hanger, according to an exemplary embodiment of present disclosure.

FIG. 7 is front view of a multi-position hanger 700, according to another example embodiment. FIG. 8 is a side view of a multi-position hanger, shown in FIG. 7. FIG. 9 is a perspective view of a multi-position hanger shown in FIGS. 7 and 8. FIGS. 7-9 will now be referenced to show and describe still another example embodiment of a hanger 700.

The suit hanger 700 includes a main body 710. The main body 710 is curved. In this particular embodiment, the curved main body is in the form of a swoosh. Attached the top of the main body 710 is a hook offset bar 706. The hook offset bar 706 has one end attached to the main body 110 and another end attached to a question mark-shaped hook 701. A pants hanger 750 is attached to the other end of the main body 710 of the suit hanger 700. The pants hanger 750 is an open jaw type hanger and includes an open jaw connector bar 754 and a pants hanger bar 755 connected to the open jaw connector bar 754. The pants hanger bar 755 includes a sleeve 756. The sleeve increases the radius of the pants hanger and provides a greater or larger surface over which the pants drape on the pants bar. The greater or larger surface decreases the possibility of the pants bar producing a crease across the leg of the pants. In other embodiments, the pants hanger bar 755 could be made with a larger radius. Any number of materials could be used to form a sleeve 756 or a suitable pants hanger bar 755 with a radius sufficient to substantially prevent pant leg creasing The hanger 700 also has a separate wishbone 720. Thus, the wishbone 720 can be made of the same or a different material than the main body 710 of the hanger 700. In one embodiment, the wishbone 720 can even be made of molded plastic. The wishbone 720 includes an opening 910 therein (shown in FIG. 9). The main body 710, the hanger offset bar 706 and the question mark hook 701 can thread through the opening 910 during assembly.

Figure 10:
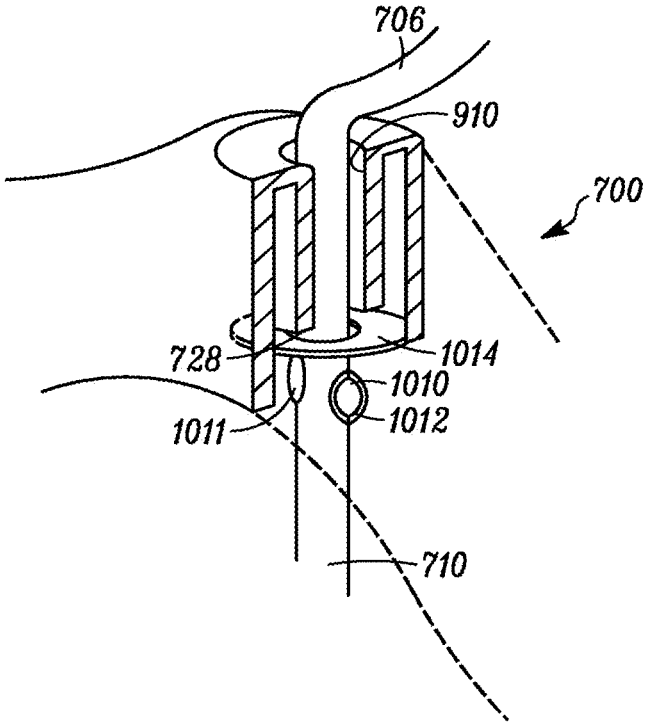
FIG. 10 is a perspective partial cut-away view of a connection of the main body of the multi-position hanger to the wishbone, according to an exemplary embodiment of present disclosure.

FIG. 10 is a perspective partial cut-away view of a connection of the main body of the multi-position hanger to the wishbone, according to an exemplary embodiment of present disclosure. The main body includes a swage 1010. The swage 1010 is formed by deforming a portion of the main body 710 of the hanger 700 which results in a first stop 1011 and a second stop 1012 along the main body 710. A washer 1014 is slipped over the hook 701 and the offset bar 706 to a position on the main body 710 above the stops 1011, 1012 of the swage 1010. The wishbone 720, in one embodiment, sits atop the washer 1014. The washer also fits within a recess 728 in the wishbone 720. As shown, the recess is formed by a shortened sidewall associated with the opening 910 in the wishbone 720. It should be noted that the wishbone 720 can be made or formed of a solid material and that the recess 728 is within the solid material. In another embodiment, adhesive can be used to hold the washer with respect to the wishbone 720 or with respect to the shaft of the main body 710 or both.

It should be noted that two of the many differences associated with the embodiment shown in FIGS. 7-10 are the use of a separate wishbone 720 and the modifications needed to attach the wishbone 720 to the main body 710 of the hanger 700. Yet another embodiment might be to manufacture the pants hanger 750, the main body 710, the offset bar 706 and the hook 701 from a single piece of stock by bending or other forming of materials.

In operation, the hanger 700 works in much the same way as the previously described embodiments. The offset bar 706 results in the wishbone 720 being offset from a pivot point on the hook 701 by a distance 724 and an offset distance 726 between the open jaw connector bar 754 and the hook 701. Each of these structures produces a moment about the pivot point. When the wishbone 720 is loaded with a coat, the resulting increase in clockwise moment results in the pants bar being placed in a kick out position. Loading the pants bar 755, 756 with pants increases a counter clockwise moment about the pivot point 780 so that the pants move to a position where the open jaw connector bar 754 is substantially vertical. The pants move toward the suitcoat and hang proximate one another.

Figure 11:
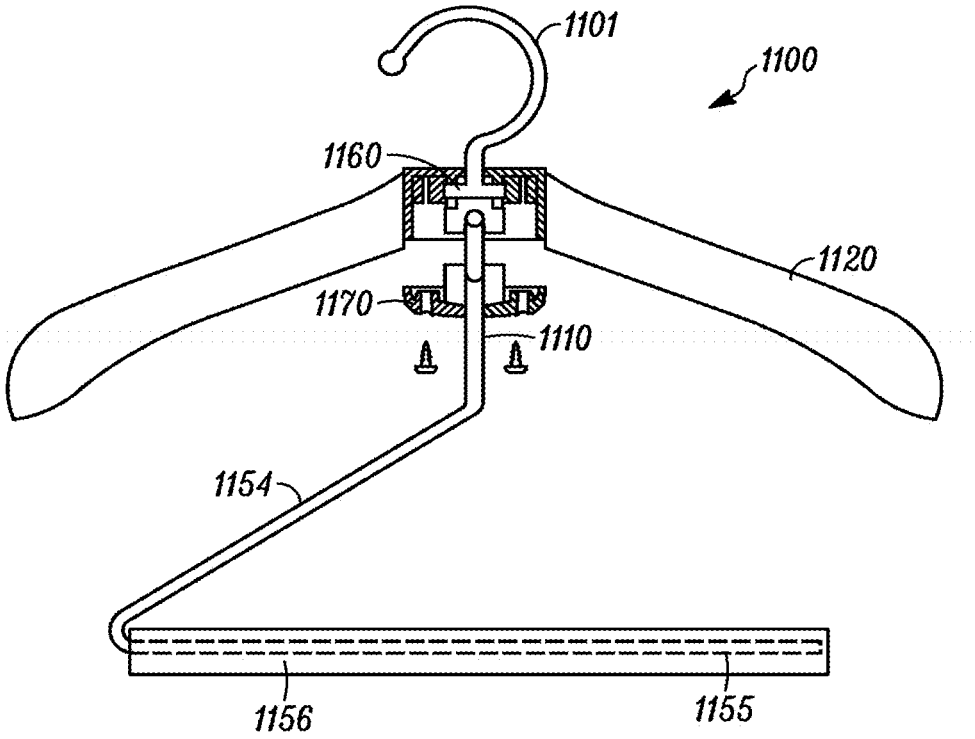
FIG. 11 partially cut-away front view of a multi-position hanger, according to yet another example embodiment.
Figure 12:
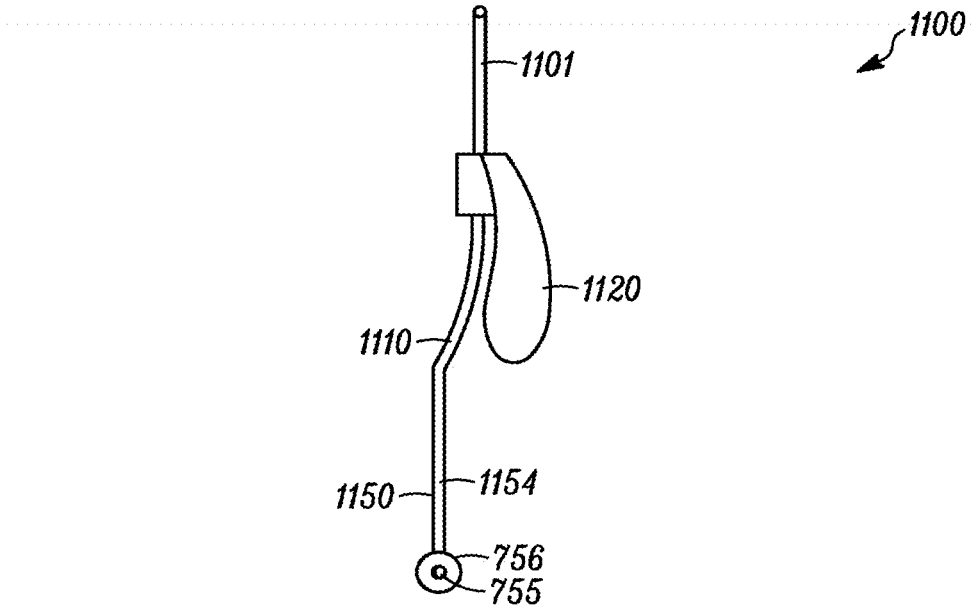
FIG. 12 side view of a multi-position hanger, according to yet another example embodiment.
Figure 13:
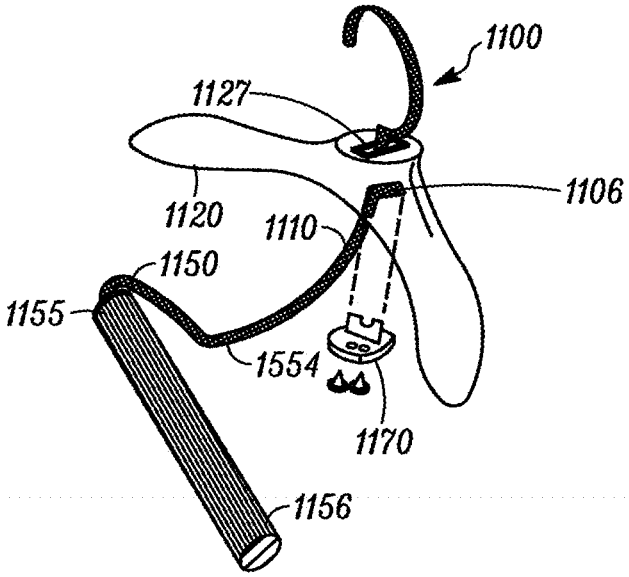
FIG. 13 partially exploded perspective view of a multi-position hanger, according to yet another example embodiment.
Figure 14:
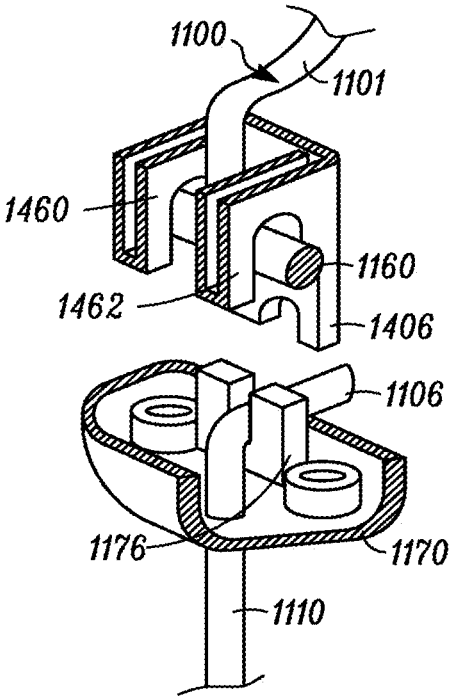
FIG. 14 a perspective partial cut-away view of a connection of the main body of the multi-position hanger to the wishbone, the wishbone and the hook, according to yet another example embodiment.

FIGS. 11-14 will now be referenced to show and describe the operation of still another example embodiment of a hanger 1100. FIG. 11 perspective view of a multi-position hanger, according to yet another example embodiment. FIG. 12 side view of a multi-position hanger, according to yet another example embodiment. FIG. 13 partially exploded perspective view of a multi-position hanger, according to yet another example embodiment. FIG. 14 a perspective partial cut-away view of a connection of the main body of the multi-position hanger to the wishbone, the wishbone and the hook, according to yet another example embodiment.

The suit hanger 1100 includes a main body 1110. The main body 110 is curved. In this particular embodiment, the curved main body is in the form of a swoosh. Attached the top of the main body 1110 is a return bar 1106. The hook offset bar 1106 has one end attached to the main body 1110. A pants hanger 1150 is attached to the other end of the main body 1110 of the suit hanger 1100. The pants hanger 1150 is an open jaw type hanger and includes an open jaw connector bar 1154 and a pants hanger bar 1155 connected to the open jaw connector bar 1154. The pants hanger bar 1155 includes a sleeve 1156. In another embodiment, shown in FIG. 13, the pants hanger bar 1155 is formed with a radius sufficient to substantially prevent formation of a crease across the pants leg along a fold line where the pants contact the pants hanger bar 1155.

The hanger 1100 also includes a wishbone 1120. One of the main differences associated with this particular embodiment is that a question mark hook 1101 includes a T-bar 1160 which is rotatably attached to the wishbone 1120. The question mark hook 1101 does not directly attach to the main body 1110. A capture plate 1170 captures the T-bar 1160 within the wishbone 1120 and allows the T-bar 1160 to pivot or rotate. This arrangement lowers the pivot point of the hanger 1100 when compared to the other embodiments discussed above (shown in FIGS. 1-10) where the pivot point is on the question mark hook 1101. The capture plate 1170 also includes a feature for capturing the return bar 1106. The return bar 1106 does not rotate with respect to the wishbone 1120. The capture plate 1170 is provided with an opening 1172 through which the main body 1110 passes. The capture plate 1170 also includes features that hold the return bar with respect to the wishbone 1120 and will not allow substantial movement between the main body 1110 and the wishbone 1120. The capture plate 1170 also includes features that allow the T-bar 1160 to rotate with respect to the wishbone 1120.

These features will now be discussed with respect to FIG. 14. The wishbone 1120 has several features. A return capture plate 1170 also includes some of the other features. As shown, the return capture plate attaches to the wishbone 1120 to complete the assembly and complete the various connections. The wishbone 1120 includes a first axle support 1460 and a second axle support 1462. The axle supports form a u-shaped slot that projects down toward the return capture plate 1170. The first axle support 1460 and the second axle support 1462 each have a pair of surfaces which terminate at or near an interior floor of the return capture plate. In other words, the floor of the return capture plate caps the u-shaped openings in the first axle support 1460 and the second axle support 1462. The ends of the T bar 1160 extend through the openings in the first axle support 1460 and the second axle support 1462. The T-bar 1160 is cylindrically shaped and has a diameter that allows the T-bar 1160 to rotate within the openings formed. The T-bar 1160 is the axle supported by the first axle support 1460 and the second axle support 1462.

The wishbone 1120 also includes a first return support 1406. As shown in FIG. 14, the first return support 1406 is broken with one end attached to the wishbone 1120 and another end wrapping or surrounding the return bar 1106. The first return support includes a u-shaped opening that wraps around the cylindrical return bar 1106. The first return support 1406 supports a first portion of the cylindrical return bar 1106. The first return support 1406 prevents or limits travel of the return bar toward the hook 1101. The return capture plate 1170 includes a second return support 1176 which also includes a u-shaped opening that wraps around a portion of the cylindrical return bar 1106. The second return support 1176 supports a second portion of the cylindrical return bar 1106 and limits travel in a downward direction. The first return support 1406 and the second return support 1176 hold the main body portion 1110 of the hanger 1100 with respect to the wishbone 1120. The return capture plate 1170 includes an opening 1172. The main body 1110 is positioned within the opening 1172 in the return capture plate 1170. This further supports the attachment of the main body 1110 with respect to the wishbone.

Figure 15:
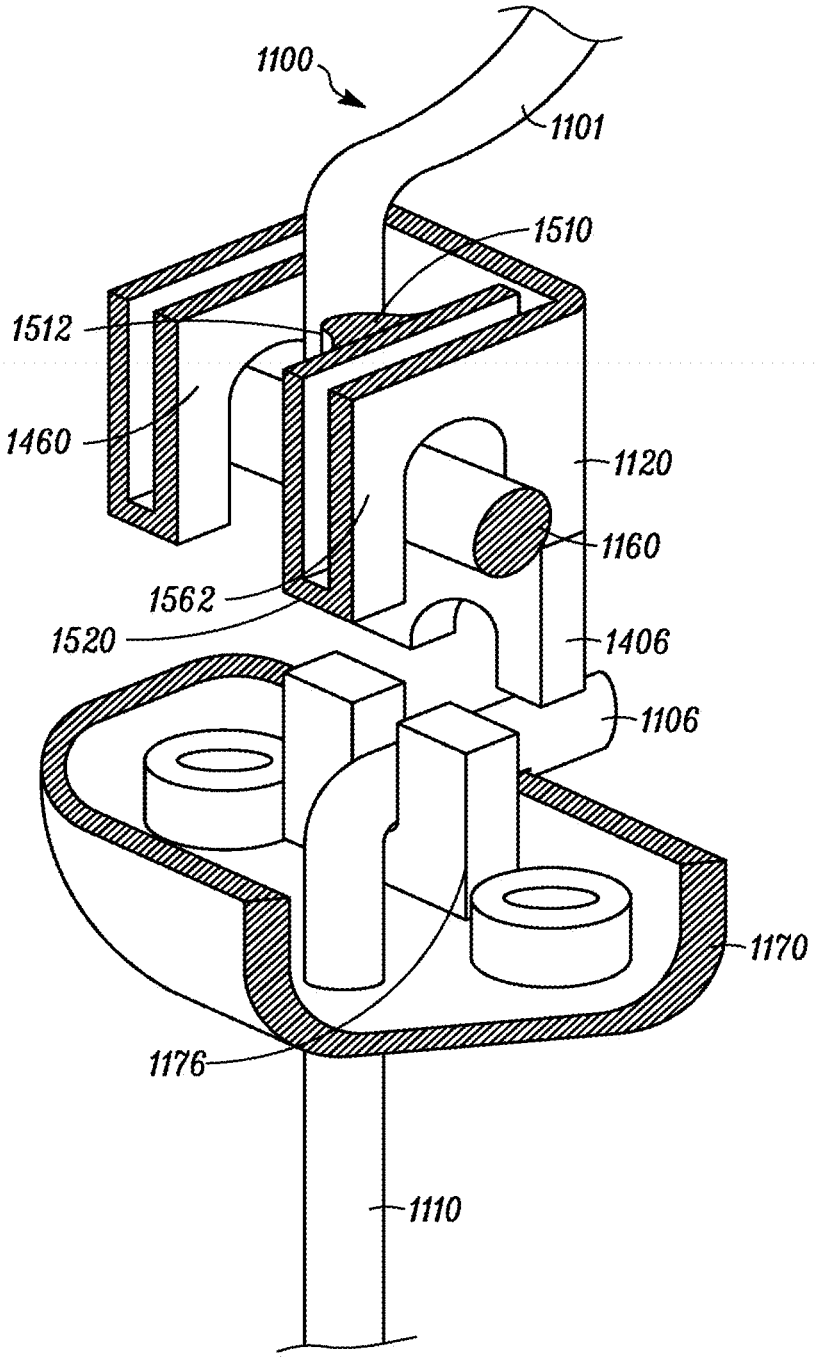
FIG. 15 is a perspective partial cut-away view of a connection of the main body of the multi-position hanger to the wishbone, the wishbone and the hook, according to still another example embodiment.

FIG. 15 a perspective partial cut-away view of a connection of the main body of the multi-position hanger to the wishbone, the wishbone and the hook, according to still another example embodiment. FIG. 15 is similar to FIG. 14. Rather than provide a full description of FIG. 15, the discussion will be limited to the differences between FIG. 14 and FIG. 15. The main difference is that one of the axle supports 1562 includes a click stop 1510. The click stop 1510 includes tab or cam surface 1512. The axle support is formed with a living hinge 1520. The living hinge produces a spring force toward the other axle support. The hanger hook and T bar assembly rotate between a nested position and a kickout position in which the pants bar is kicked out or presented to the user. The click stop 1510 is shaped to hold the hook in one of the kickout position or the nested position regardless of what the hanger 1500 is holding. The rotational position of the hook and T-bar assembly can be changed by applying an additional force between the wishbone 1120 and the hook 1101. This moves the hook 1101 over the click stop 1110 or more specifically over the tab or cam surface to the other position. Advantageously, the pants bar can be held in the kick out position without having to load the jacket or coat on the wishbone. This may ease use of the hanger 1500 by certain users.

Figure 16:
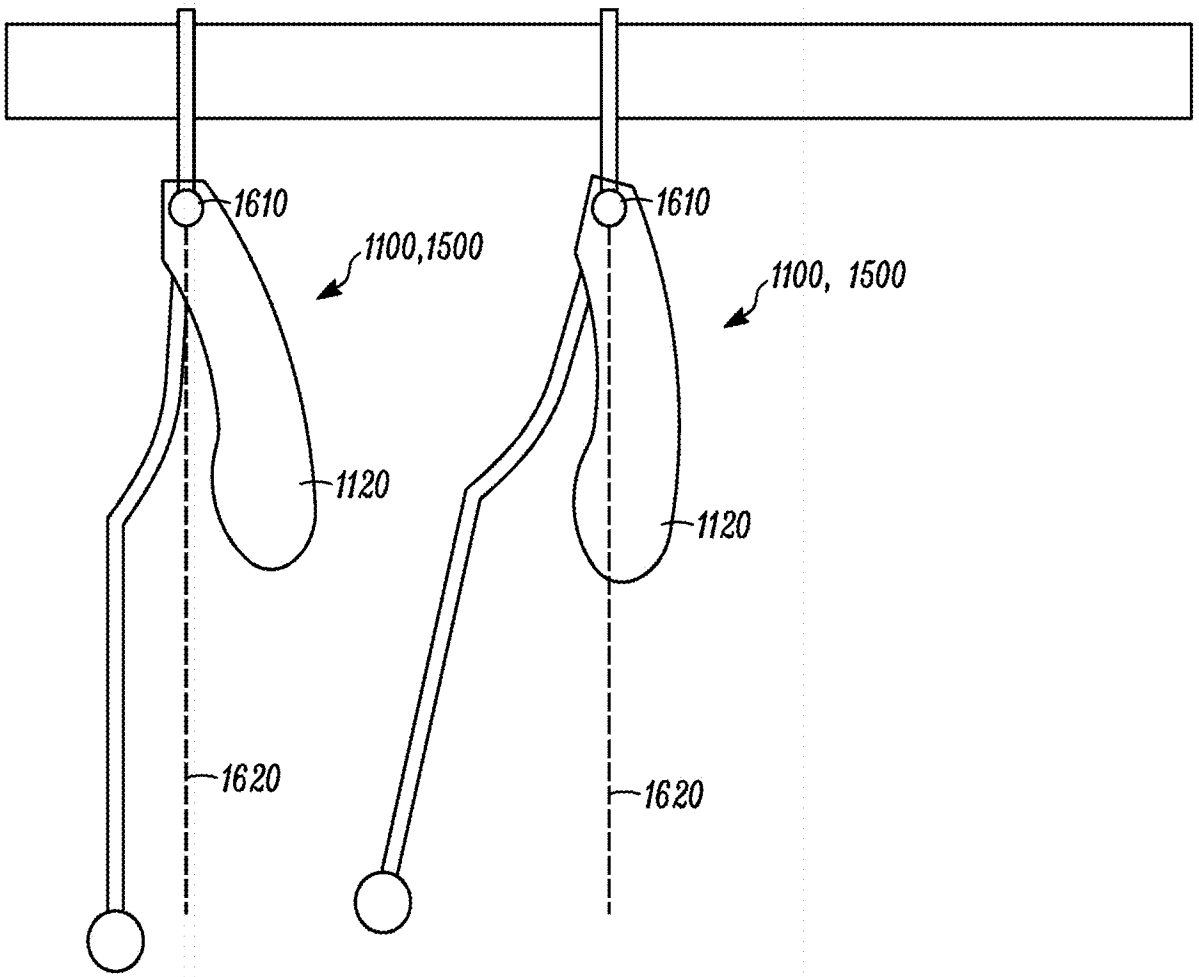
FIG. 16 a schematic view of a connection of the multi-position hanger with a pivot point in the wishbone, in a nested position and in a kick out position, according to an exemplary embodiment of present disclosure.

FIG. 16 a schematic view of a connection of the multi-position hanger 1100 with a pivot point 1610 in the wishbone 1120, in a nested position and in a kick out position, according to an exemplary embodiment of present disclosure. The kickout position is shown on the right of FIG. 16. In this position, the pants bar is farther away from an axis of the hanger which passes through the hook and the pivot point 1610 than in the fully nested position. It should be noted that the fully nested position is about the same as the unloaded position where no articles of clothing are on the pants bar or the wishbone. It should also be noted that the embodiments shown in FIGS. 14 and 15 will act similarly and that this schematic is equally applicable to both these embodiments.

As mentioned above, the hangers 1100 and 1500 have a separate wishbone 1120. Thus, the wishbone 1120 in these embodiments can be made of the same or a different material than the main body 1110 of the hanger 1100. In one embodiment, the wishbone 1120 can even be made of molded plastic.

Figure 17:
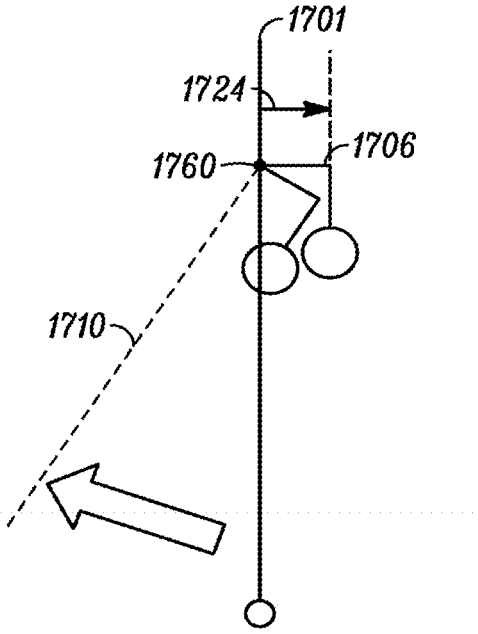
FIG. 17 is a schematic of still another embodiment of a hanger with lower pivot point, according to an exemplary embodiment of present disclosure.
Figure 18:
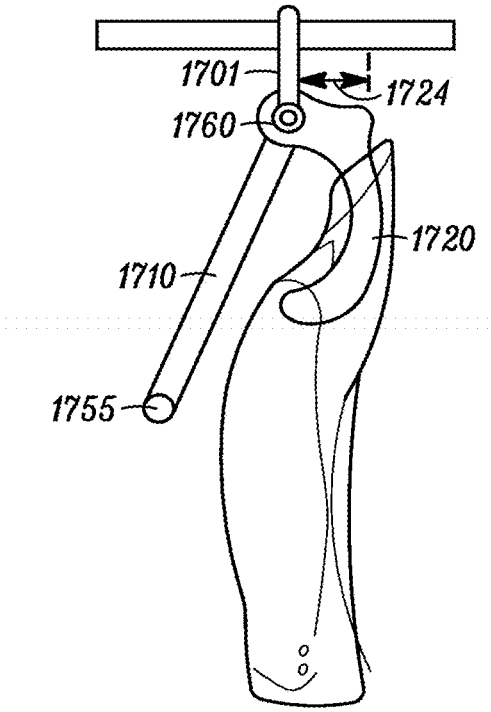
FIG. 18 is a side view of still another embodiment of a hanger with a coat on the wishbone, according to an exemplary embodiment of present disclosure.
Figure 19:
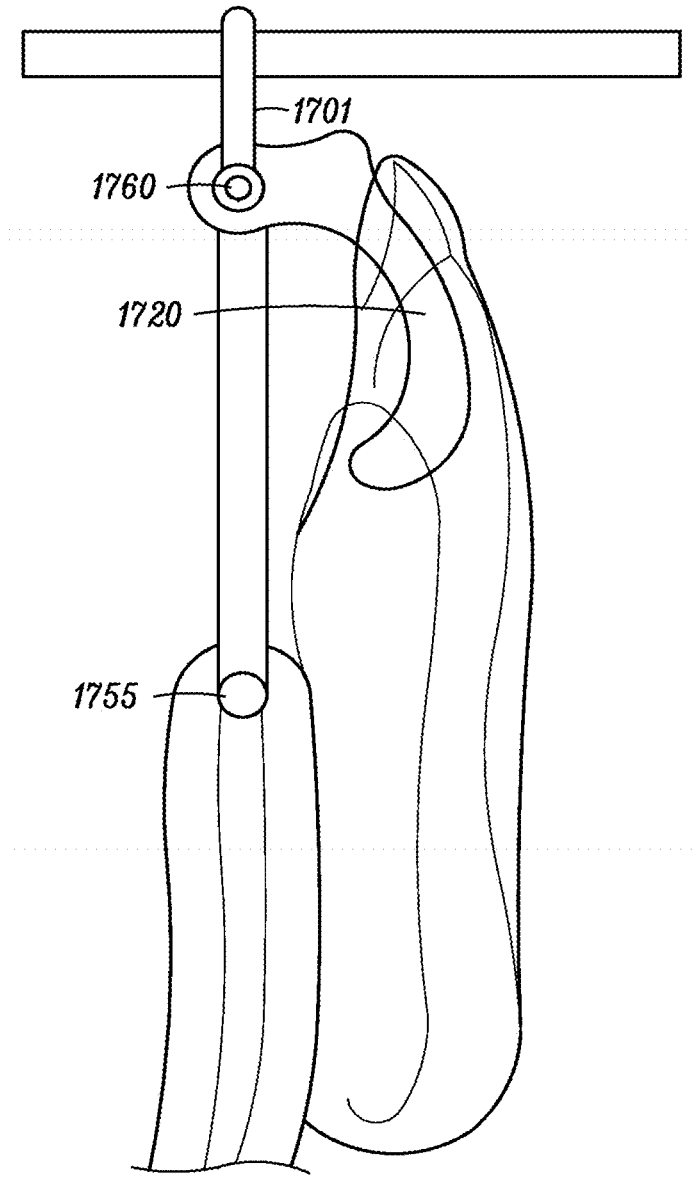
FIG. 19 is a side view of still another embodiment of a hanger with a coat on the wishbone and pants on the pants hanger bar, according to an exemplary embodiment of present disclosure.

FIG. 17 is a schematic of still another embodiment of a hanger 1700 with lower pivot point, according to an exemplary embodiment of present disclosure. FIG. 18 is a side view of still another embodiment of a hanger 1700 with a coat on the wishbone, according to an exemplary embodiment of present disclosure. FIG. 19 is a side view of still another embodiment of a hanger 1700 with a coat on the wishbone and pants on the pants hanger bar, according to an exemplary embodiment of present disclosure. Now referring to FIGS. 17-19, this embodiment will be further detailed.

The hanger 1700 includes a question mark hook 1701 and a cylindrical T-bar 1760 attached to the end of the question mark hook 1701, The question mark hook 1701 and T-bar, are similar to the embodiment shown in FIG. 14. The hanger 1700 also has a wishbone 1720 and a main body 1710. The wishbone 1720 is attached to the main body of the hanger 1710. A pants hanger bar 1755 is attached to the main body 1710.

The T-bar is cylindrical. The main body 1710 and wishbone 1720 rotate about the axis of the T-bar. The wishbone 1720 is offset from the cylindrical T-bar 1760 by a distance 1724. This offset can be formed at part of the wishbone 1720 or can be formed as a separate offset bar 1706. The wishbone 1720, the main body, and the pants bar 1755 all pivot around the cylindrical surface of the T-bar 1760.

When a load is placed on the wishbone 1720, a clockwise moment is increased around the axis of rotation at the T-bar 1760. This causes wishbone 1720, the main body 1710 and the pants bar 1755 to rotate clockwise to a kick out position, as shown in FIG. 18. The pants bar 1755 is positioned away from the load (suit coat) on the wishbone 1720. The pants can be loaded onto the pants hanger bar 1755. This produces a counterclockwise moment to move the pants bar from the kickout position to the nested position shown in FIG. 19.

In summary, the various embodiments include a multi-position hanger including a main body, a hook, a wishbone and a pants bar. The hook is attached to the main body, and the wishbone attached to the main body. The wish bone is offset from the hook in a first direction. The pants bar is attached to the main body and is also offset from the hook in a second direction. The multi-position hanger rotates to a kick out position in response to placing a load on the wishbone. The pants bar is positioned at a first distance from the load on the wishbone in the kick out position. The multi-position hanger rotates to a nested position in response to placing a load on the pants bar. The pants bar is positioned at a second distance from the load on the wishbone when in the nested position, the first distance being greater than the second distance. In one embodiment of the multi-position hanger, a pivot point is associated with the hook. In another embodiment, of the multi-position hanger a pivot point within the wishbone. In still another embodiment of the hanger the pivot point is located below the hook.

The multi-position hanger of further includes an offset bar. The offset bar attaches the wishbone at a distance away from the pivot point to produce a moment about the pivot point in a first direction. The pants bar attached to the multi-position hanger at a distance away from the pivot point to produce a moment about the pivot point in a second direction, the first direction being opposed to the second direction. In one embodiment, the offset bar is used to provide the offset to produce one or both of these moments about the pivot point. The first distance the pants bar is from load on the wishbone when in the kick out position is increased by increasing the distance the wishbone is offset from the pivot point.

In another embodiment, the hook of the multi-position hanger is rotatably attached to the wishbone to form the pivot point within the wishbone. In this embodiment, the multi-position hanger includes a cylindrical T bar attached to the hook. The cylindrical T bar is captured within the wishbone on at least one feature that allows the T-bar to rotate about a cylindrical axis of the T bar. The cylindrical axis passes though the radial center of the two ends of the cylinder. The multi-position hanger also includes a capture plate which attaches to a portion of the wishbone to capture the T-bar. The capture plate includes another feature for receiving a main body portion to attach the main body to the wishbone. The wishbone includes a slot through which the hook passes. The slot allows the hook and T-bar to rotate with respect to the wishbone.

In one embodiment, the pants bar includes a sleeve that fits over the pants bar. The sleeve increases the radius of the pants hander bar to reduce creasing across the leg of a pair of pants. The sleeve can be formed of a smooth material or a foam material which increases the friction between the pants bar and the pants. The sleeve can be made of other materials as well.

In still another embodiment, the multi-position hanger of further includes comprising a click stop which attaches to a portion of the wishbone. The click stop holds the hanger in at least one of the kick out position or the nested position. This can be held in either position regardless of whether the hanger is loaded or unloaded. In multi-position hanger with a click stop, the hook and T-bar are rotatable between the kick out position and the nested position. The click stop allows the rotation of the hook and T-bar between the positions. The click stop also holds the hook and T bar in one of the kick out position or the nested position.

Another multi-position hanger 1800 that is rotatable between a nested position and at least one kick out position is shown in FIGS. 20-29 The multi-position hanger 1800 is similar to the multi-position hangers discussed above, and therefore the description above to like aspects or functions equally applies to that of hanger 1800. As shown in FIGS. 20-29, the hanger 1800 differs from the hangers discussed above in the adjustment mechanism between the stem portion 1804 of the hook member 1801 and the wishbone member 1820 that provides the adjustability between the nested position and the at least one kick-out position (see FIG. 29).

Figure 20:
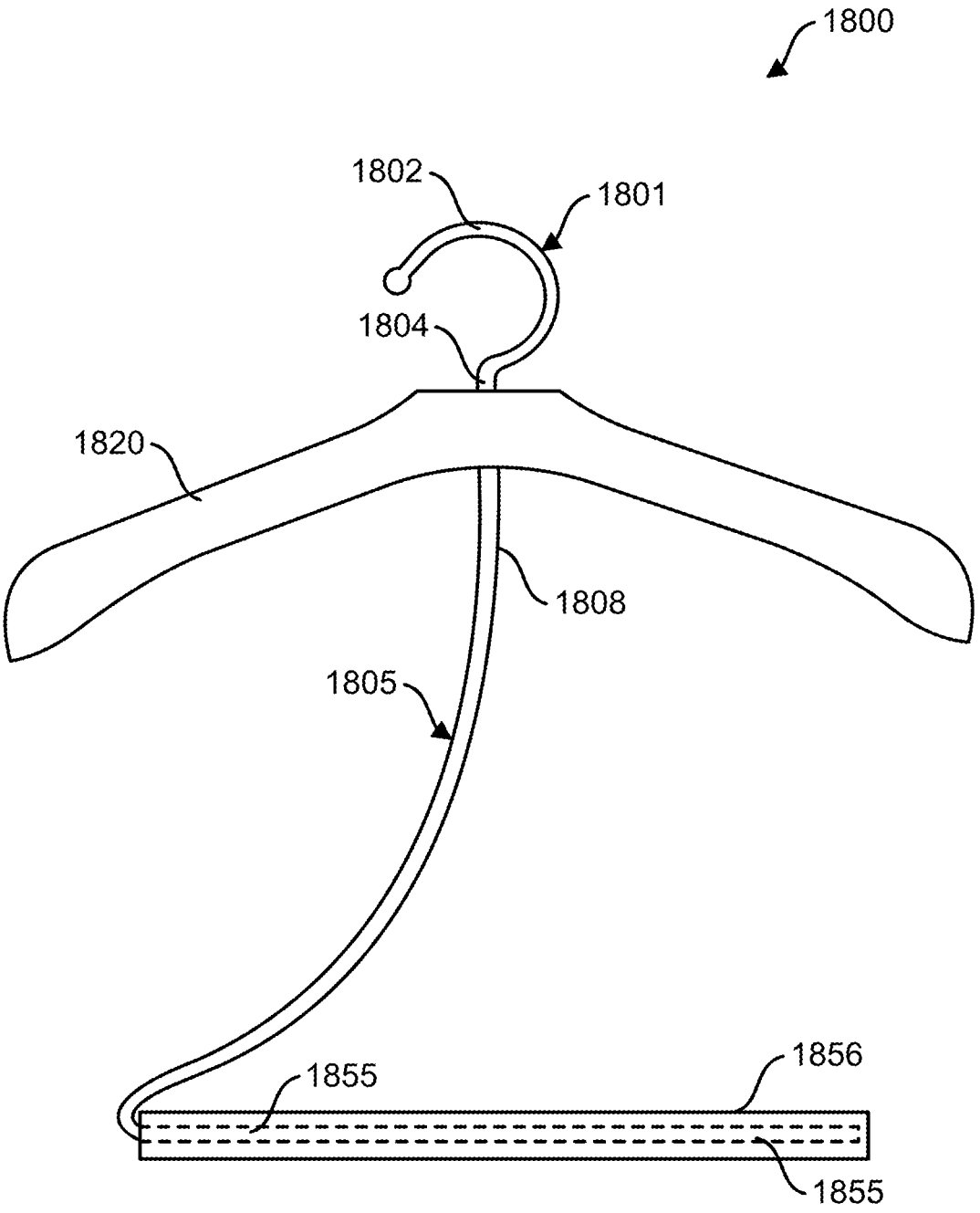
FIG. 20 is a front view of a multi-position hanger, according to an exemplary embodiment of present disclosure.
Figure 21:
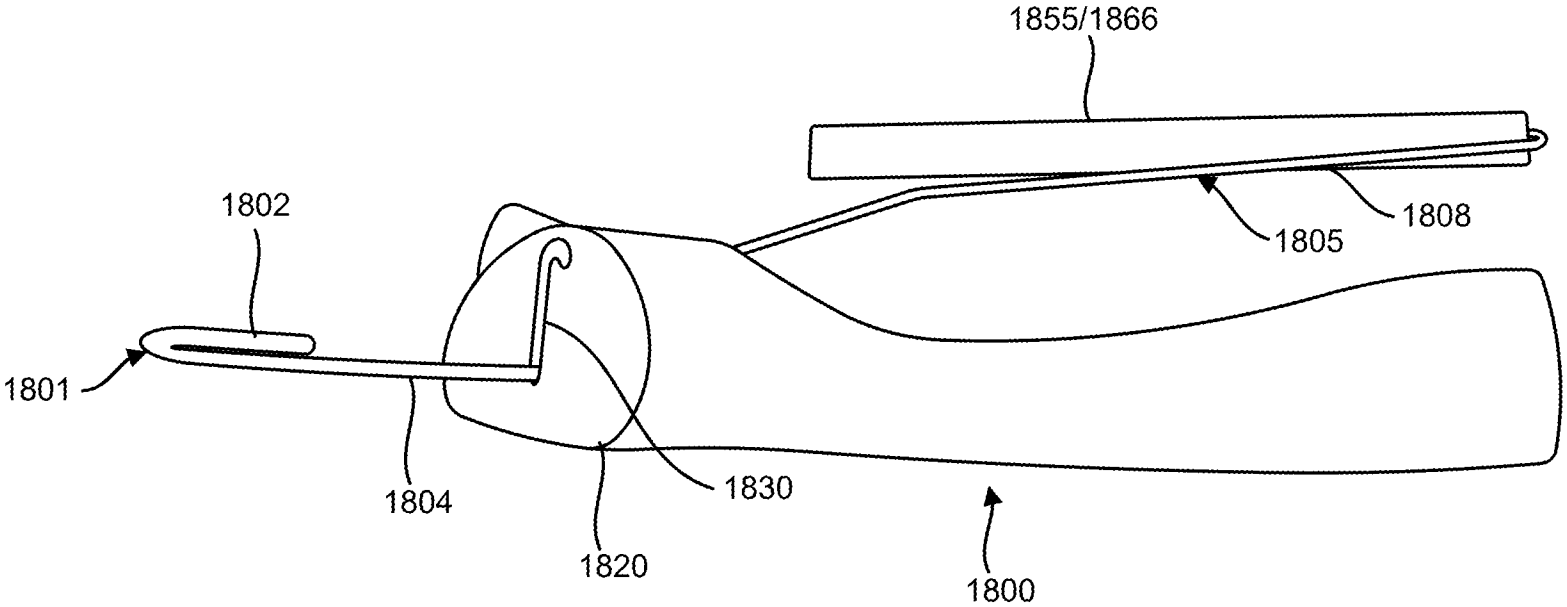
FIG. 21 is a perspective view of the multi-position hanger of FIG. 21.
Figure 22:
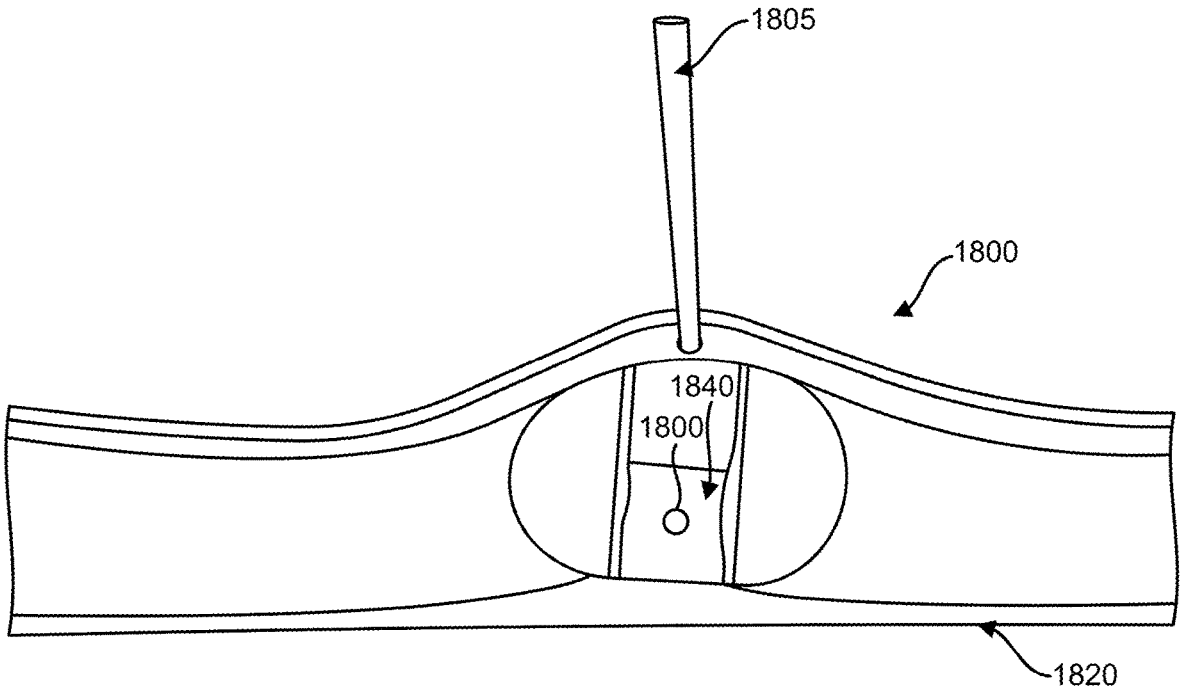
FIG. 22 is a bottom view of the multi-position hanger of FIG. 21.
Figure 23:
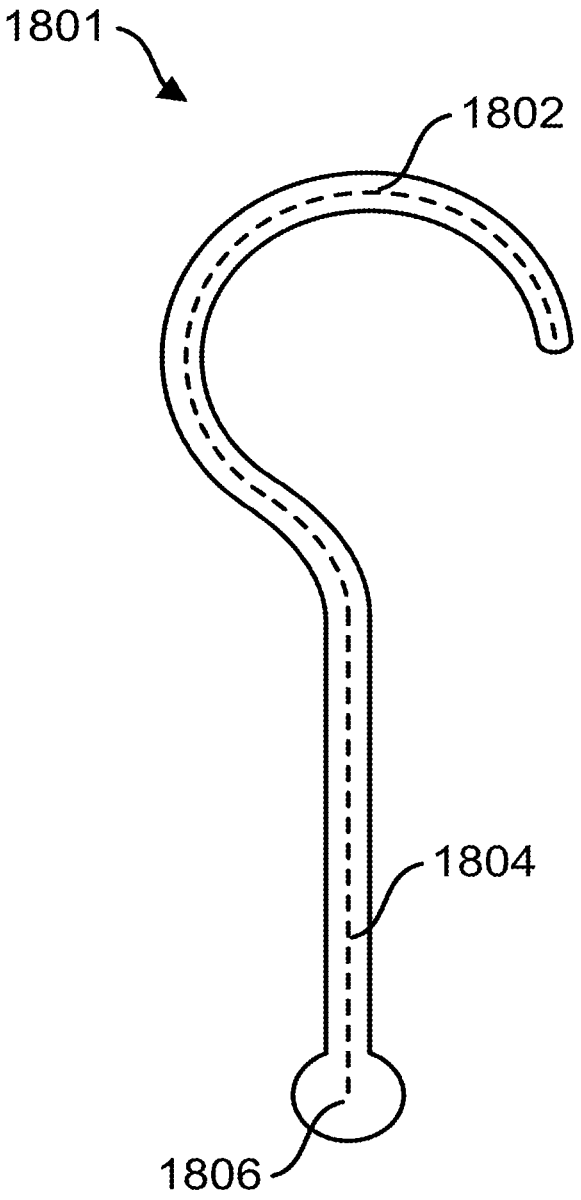
FIG. 23 is a front view of a hook member of the multi-position hanger of FIG. 21, according to an exemplary embodiment of present disclosure.
Figure 29:
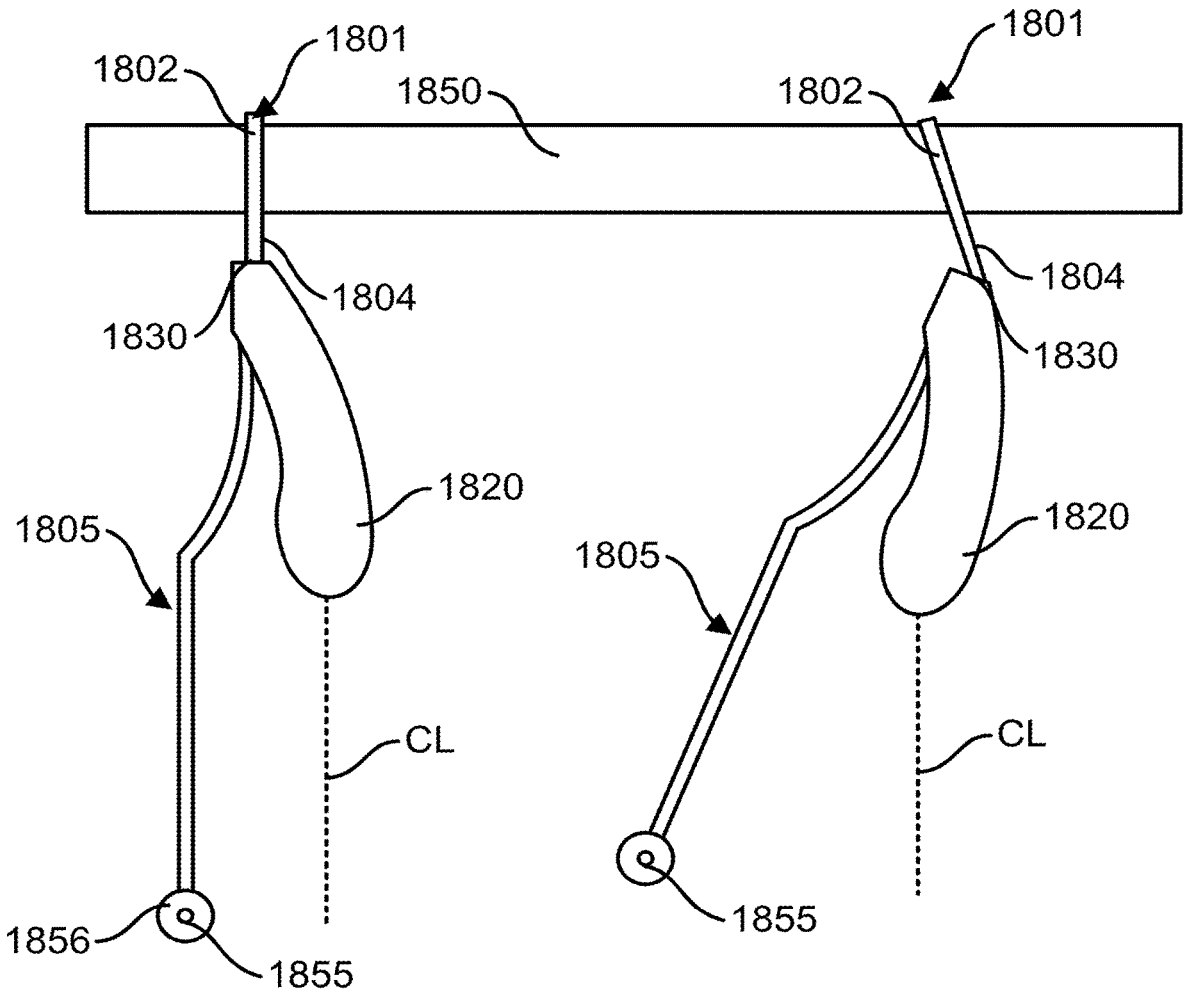
FIG. 29 is a side view illustrating the multi-position hanger of FIG. 21 hanging on a support and in a nested orientation and in a kick out orientation.

As shown in FIGS. 20-29, the arm member 1805 is rigidly or fixedly attached to the wishbone 1820. For example, as shown in FIGS. 20, 22 and 29, the arm member 1805 may extend from a bottom or internal portion of the wishbone 1820, such as from a medial portion of the wishbone 1820 between the ends of the opposing arm or shoulders thereof. As described above, the arm member 1805 may have an arced, offset, swoosh and/or connector portion 1808 that extends at least partially (or fully) between the wishbone 1820 and the pants bar portion 1855. As also described above, the pants bar 1855 may be linear and at least generally horizontal during use.

Figure 24:
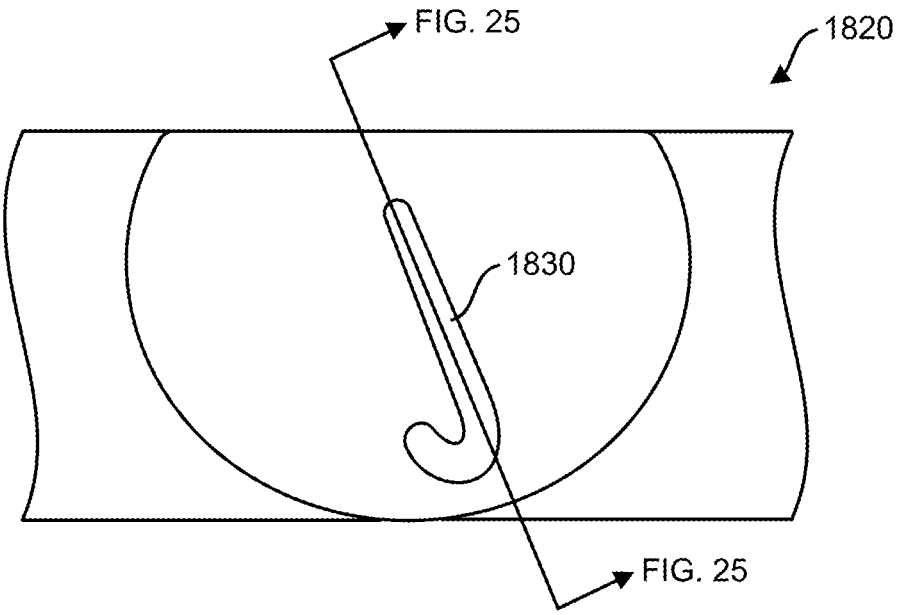
FIG. 24 is a top view of a wishbone portion of the multi-position hanger of FIG. 21, according to an exemplary embodiment of present disclosure.
Figure 25:
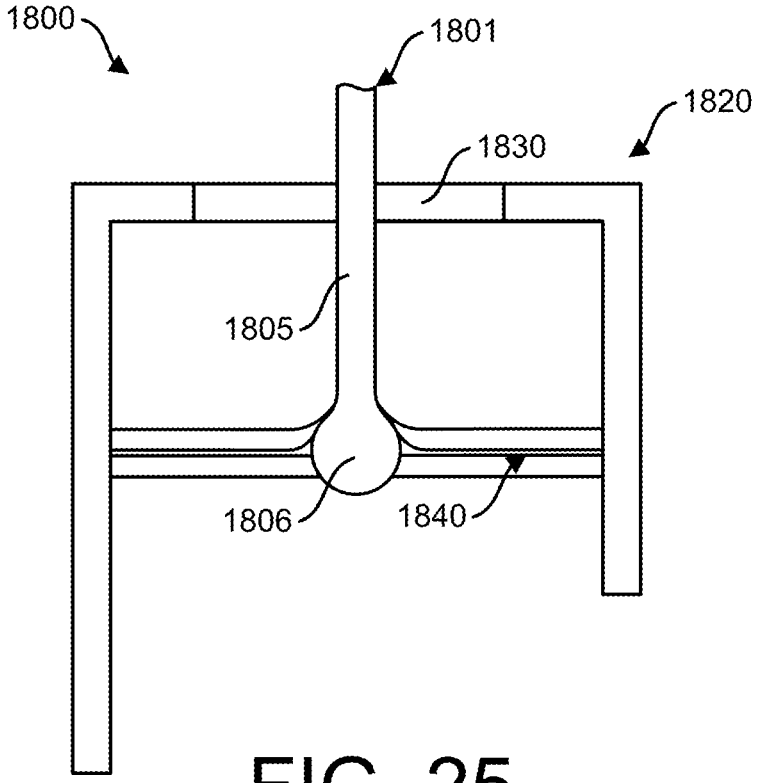
FIG. 25 is a side cross-sectional view of a portion of the multi-position hanger of FIG. 21.
Figure 26:
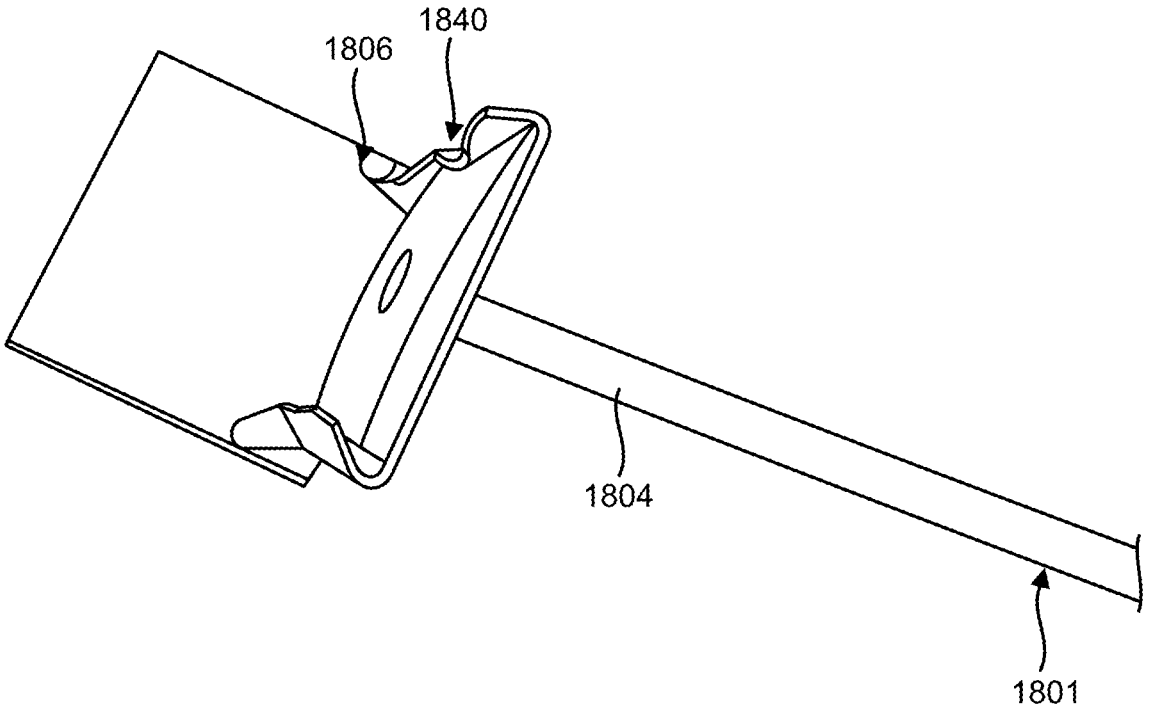
FIG. 26 is a bottom perspective view of a ball-and-socket joint of the multi-position hanger of FIG. 21, according to an exemplary embodiment of present disclosure.
Figure 27:
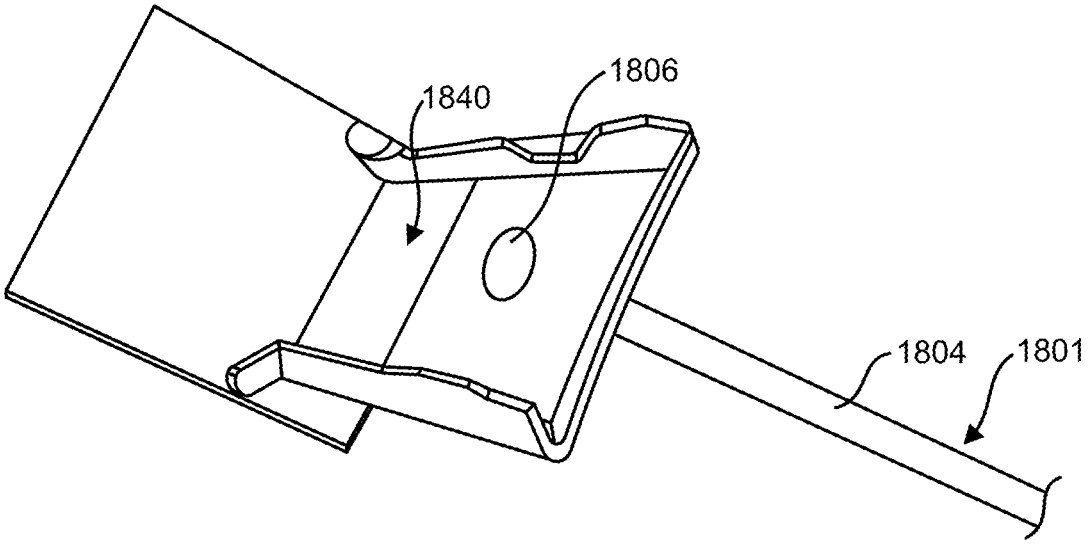
FIG. 27 is another bottom perspective view of a ball-and-socket joint of the multi-position hanger of FIG. 21.
Figure 28:
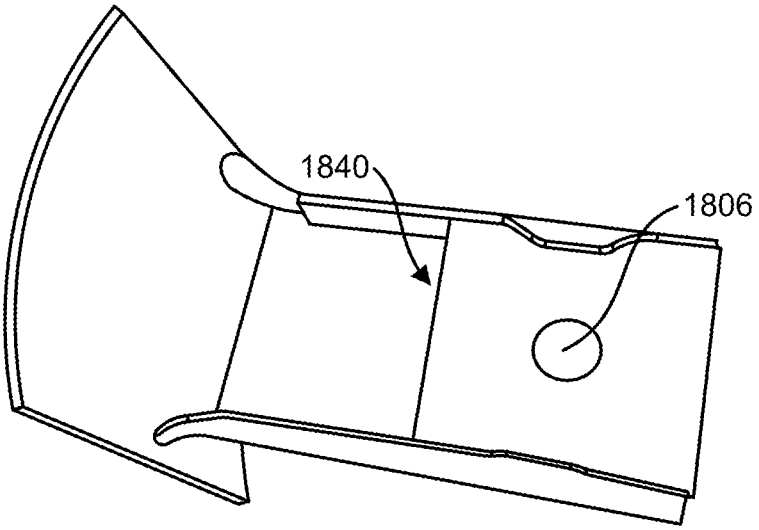
FIG. 28 a bottom view of a ball-and-socket joint of the multi-position hanger of FIG. 21.

As also shown in FIGS. 20-29, the stem portion 1804 of the hook member 1801 may be pivotably and/or rotatably coupled to the wishbone 1820. For example, the may extend from a top or internal portion of the wishbone 1820, such as from and/or through a medial portion of the wishbone 1820. As shown in FIGS. 21, 24 and 25, the stem portion 1804 of the hook member 1801 may extend through a "J" or hooked shaped slot 1830. In some embodiments, the slot 1830 of the wishbone 1820 may be formed in a top neck portion of the wishbone 1820, as shown in FIGS. 21, 14 and 25. However, the slot 1830 may be formed within the interior of the wishbone 1820 or be otherwise positioned on/in the wishbone or a component coupled to the wishbone 1820. The slot 1830 is "J" or hooked shaped such that it includes two ends or sides that face the same lateral side of the hanger 1800 and/or the wishbone 1820 (e.g., may both face a front lateral side of the wishbone 1820, which the pants bar 1855 may be positioned adjacent to). The slot 1830 may thereby extend, or be extended, along a lateral direction of the wishbone 1820 with a first end of the slot 1830 positioned proximate to a back lateral side and distal to a front lateral side of the wishbone 1820, and a second end of the slot 1830 positioned proximate to the front lateral side and distal to the back lateral side of the wishbone 1820. However, as noted above and explained further below, the first and second ends of the slot 1830 are configured to face the same lateral side of the wishbone 1820 (i.e., the back or front lateral side of the wishbone 1820).

The stem portion 1804 of the hook member 1801 may extend through the slot 1830, and the slot 1830 and the stem portion 1804 may be configured such that the stem portion 1804 can travel or translate through the slot 1830 from the first end to the second end thereof. In some embodiments, the slot 1830 may include a linear or relatively slightly arcuate portion that extends from the back lateral side (or the front lateral side) of the wishbone 1820, and a relatively sharply arcuate portion that extends from the front lateral side (or the back lateral side) of the wishbone 1820, as shown in FIG. 24. In some embodiments, the relatively sharply arcuate portion of the slot 1830 may define a width that is greater than the linear or relatively slightly arcuate portion thereof and/or the first and/or second ends thereof.

As shown in FIGS. 22, 23 and 25-28, the hook member 1801 may include a ball or spherical end portion 1806 at an end of the stem portion 1805 that is rotatably coupled to a socket portion 1840 of the wishbone 1820. As discussed above, the socket portion 1840 of the wishbone 1820 may be positioned within an interior of the wishbone 1820 such that the hook member 1801 is rotatably coupled to the wishbone 1820 within an interior of the wishbone 1820. The spherical end portion 1806 of the stem portion 1805 and the socket portion 1840 of the wishbone 1820 may thereby be positioned below the slot 1830 such that the stem portion 1805 extends through the slot 1830 with the spherical end portion 1806 and the socket portion 1840 positioned below the slot 1830 and within an interior or cavity of the wishbone 1820, as shown in FIG. 25. The spherical end portion 1806 and the socket portion 1840 of the wishbone 1820 are configured to rotatable mate or couple to form a ball-and-socket joint that allows for multidirectional movement and rotation about an axis of the stem portion.

As shown in FIGS. 25-28, the socket portion 1840 of the wishbone 182 may comprise first and second plate portions that capture the spherical end portion 1806 and the socket portion 1840 therebetween. For example, the socket portion 1840 of the wishbone 182 may comprise a first bottom plate with an aperture or recess that accepts a bottom portion of the spherical end portion 1806 therein below a diameter or larger-cross-sectional portion of the spherical end portion 1806, and a second top plate with an aperture that allows the stem potion 1805 to pass through and move/angle therein and accepts a top portion of the spherical end portion 1806 therein above a diameter or larger-cross-sectional portion of the spherical end portion 1806.

As shown in FIG. 24, the first end surface of the hooked-shaped slot 1830 may be positioned proximate to a first lateral side and distal to second lateral side of the wishbone 1820, and a second end surface of the hooked-shaped 1830 slot is positioned proximate to the second lateral side and distal to first lateral side of the wishbone 1820. As also shown in FIG. 24, the hooked-shaped slot 1830 comprises a linear portion that extends along the lateral direction from the second end surface thereof, and an arcuate portion that extends from the first end surface thereof to the linear portion. The arcuate portion may extend laterally and along a longitudinal direction that extends between the first and second free ends of the wishbone 1820, as shown in FIG. 24.

The stem portion 1804 of the hook member 1801 extends through and is translatable within the hook-shaped slot 1830 of the wishbone 1820. For example, the wishbone 1820 and the pants bar 1855 are selectively repositionable with respect to the hook member 1801 when the hook portion 1802 hangs on a support 1850 between a kick out orientation of the hanger 1800 with the pants bar 1855 positioned at a first lateral position with respect to a reference line extending vertically downward from the wishbone 1820, such as a reference centerline CL extending from a center portion of an end of the wishbone 1820 as shown by the left-hand hanger 1800 in FIG. 29, and a nested orientation of the hanger 1800 with the pants bar 1855 positioned at a second lateral position with respect to the centerline CL as shown by the right-hand hanger 1800 in FIG. 29.

The first and second lateral positions are differing lateral positions with respect to the centerline CL. As shown by the right-hand hanger 1800 in FIG. 29, when the hanger 1800 is in the kick out orientation, the first lateral position of the pants bar 1855 is laterally spaced from the centerline CL. In some embodiments, as shown by the left-hand hanger 1800 in FIG. 29, when the hanger 1800 is in the nested orientation, the second lateral position of the pants bar 1855 is laterally spaced from the centerline CL. In some other embodiments (not shown), when the hanger 1800 is in the nested orientation, the second lateral position of the pants bar 1855 is laterally aligned with the centerline Cl.

As shown in FIG. 21, in the nested orientation of the hanger 1800, the stem portion 1804 is positioned against the second end surface of the hook-shaped slot 1830 to retain the hanger 1800 in the nested orientation. Further, in the kick out orientation of the hanger 1800, the stem portion 1804 is positioned against the first end surface of the hook-shaped slot 1830 to retain the hanger 1800 the kick out orientation, as shown by the right-hand hanger 1800 in FIG. 29.

A first lateral side of the hook member 1801 and the pants bar 1855 may form a first angle therebetween (with respect to the pivot or rotation point formed by the spherical end portion 1806 and the socket portion 1840). As shown in FIG. 29, the first angle is smaller in the kick out orientation of the hanger 1800 than in the nested orientation of the hanger 1800. Similarly, a first lateral side of the hook member 1801 and the wishbone 1820 may form a second angle therebetween (with respect to the pivot or rotation point formed by the spherical end portion 1806 and the socket portion 1840). As shown in FIG. 29, the second angle is smaller in the kick out orientation of the hanger 1800 than in the nested orientation of the hanger 1800.

Figure 30:
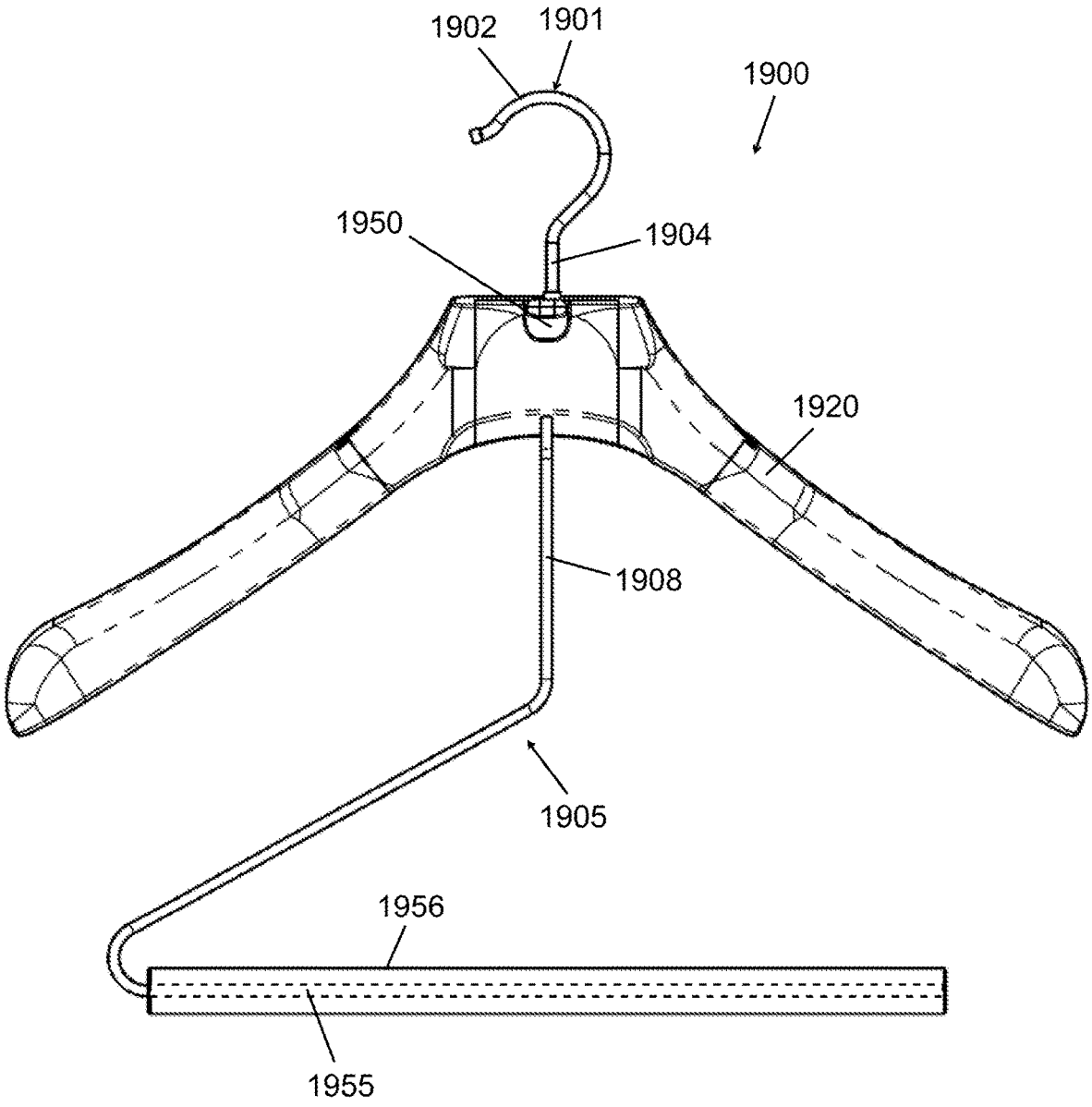
FIG. 30 is a front view of a multi-position hanger in a nested orientation, according to an exemplary embodiment of present disclosure.
Figure 31:
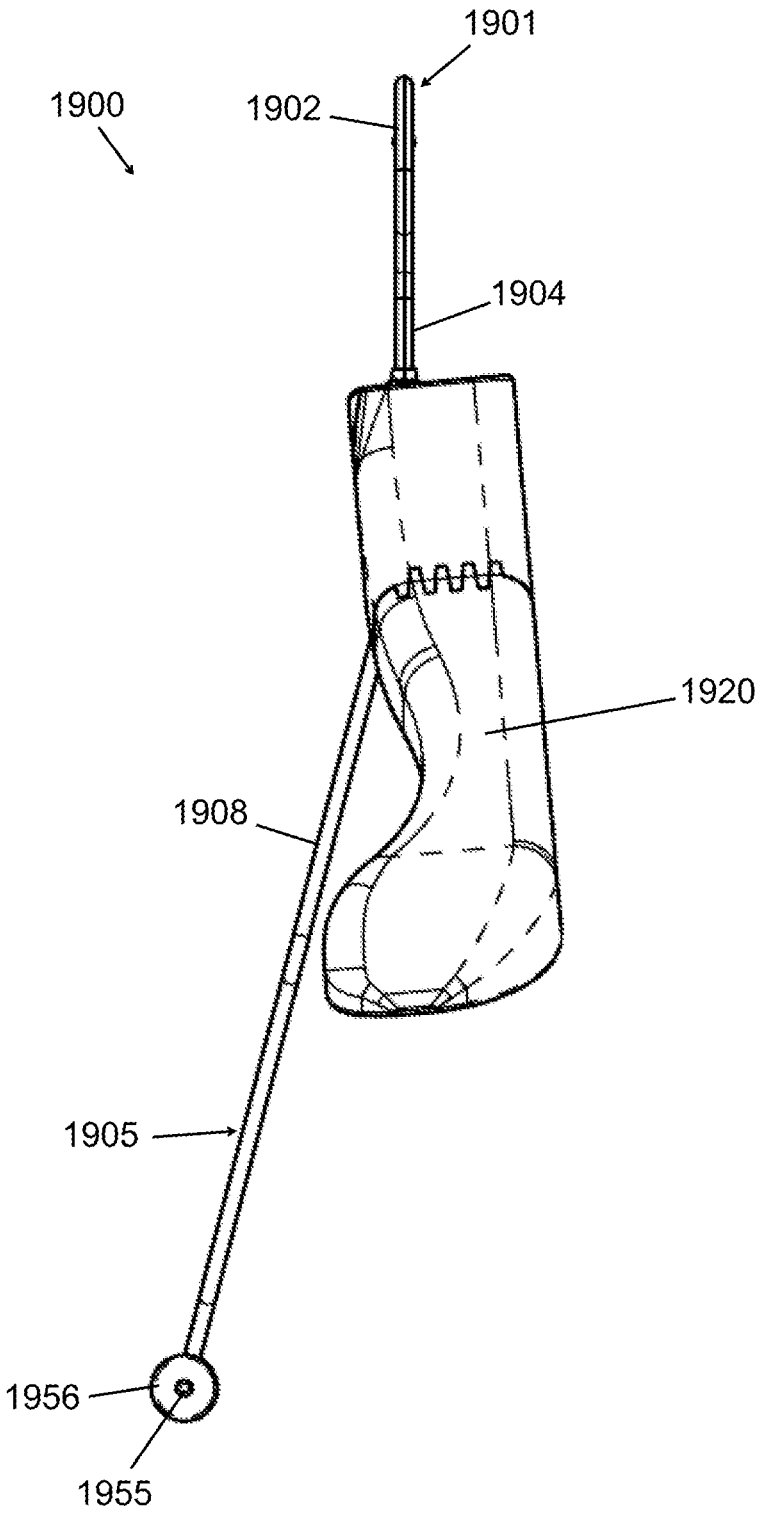
FIG. 31 is a side view of the multi-position hanger of FIG. 30 in the nested orientation.
Figure 32:
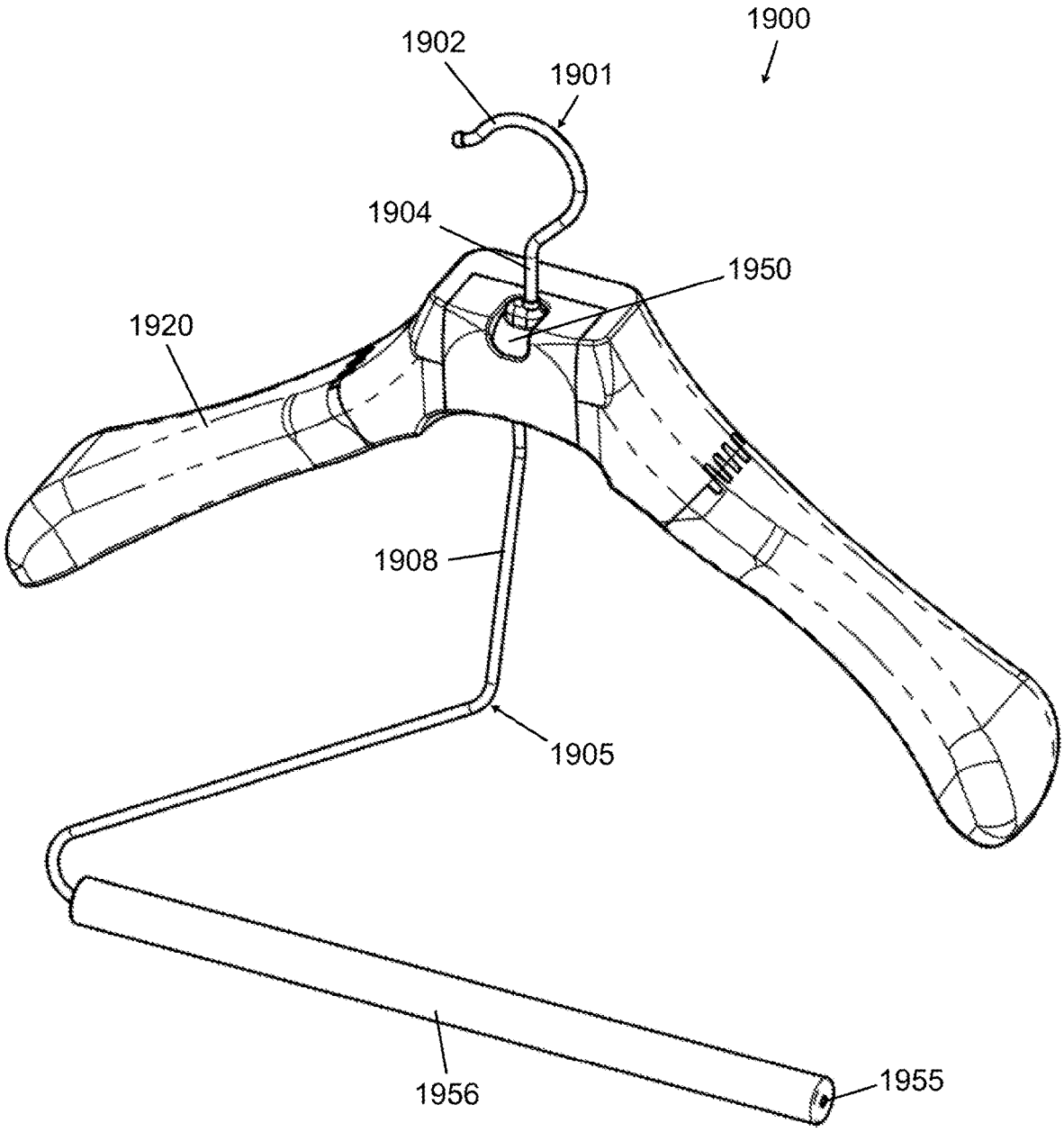
FIG. 32 is a perspective view of the multi-position hanger of FIG. 30 in the nested orientation.
Figure 33:
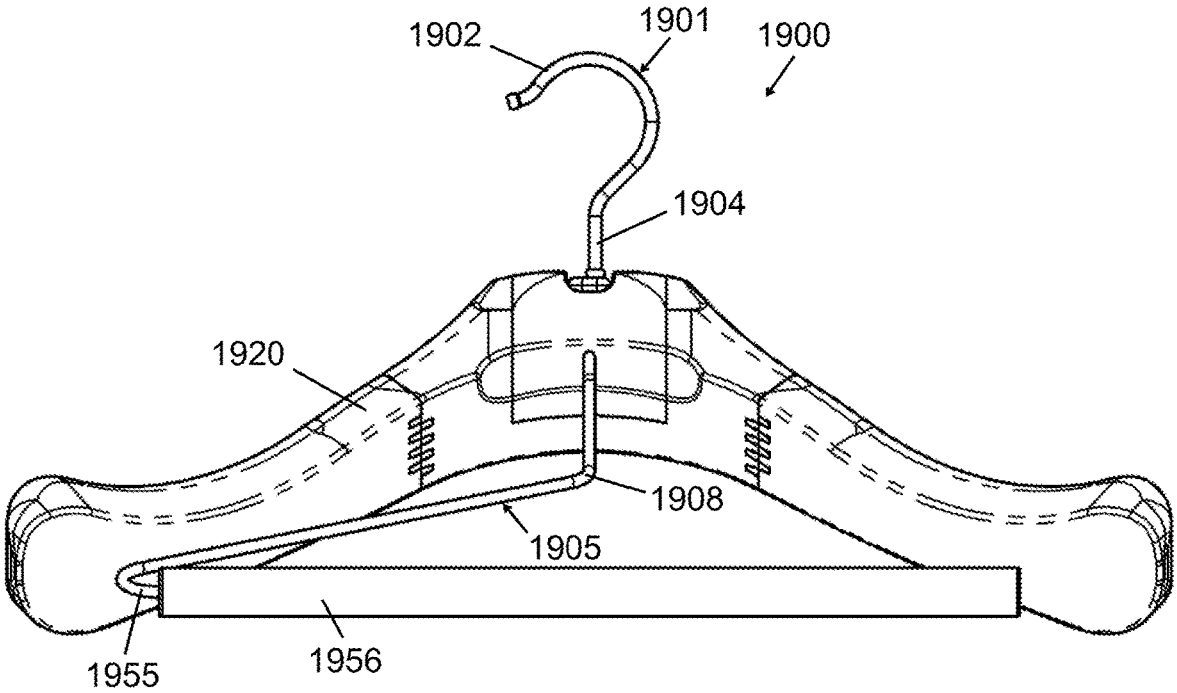
FIG. 33 is a front view of the multi-position hanger of FIG. 30 in a kick out orientation.
Figure 34:
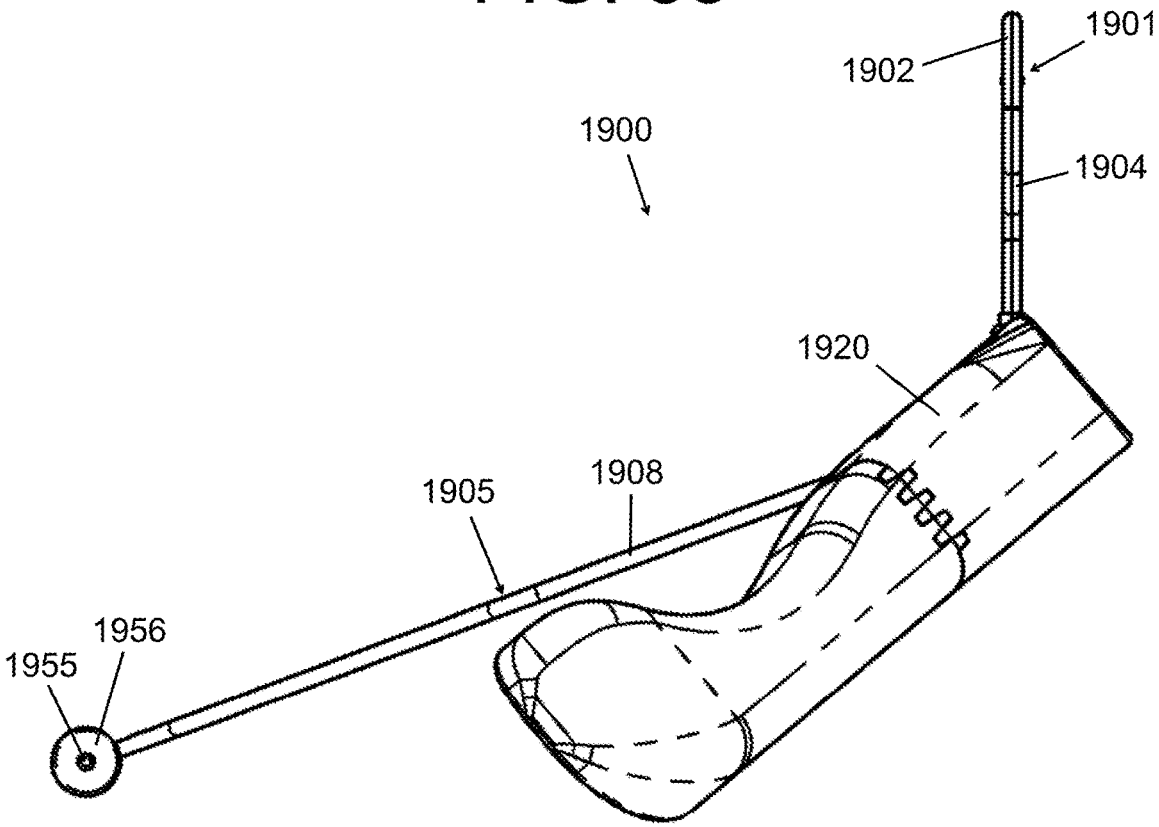
FIG. 34 is a side view of the multi-position hanger of FIG. 30 in the kick out orientation.
Figure 35:
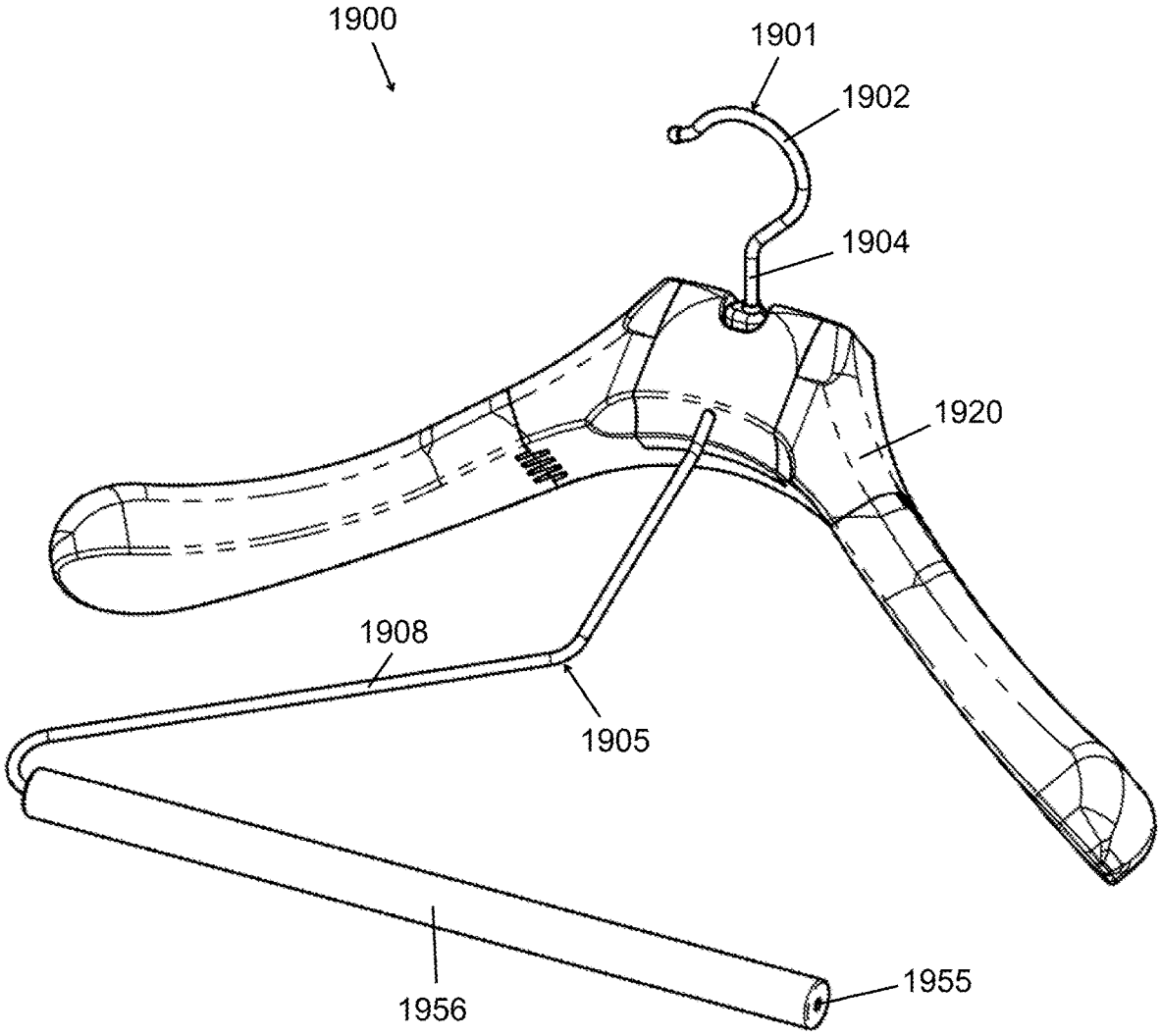
FIG. 35 is a perspective view of the multi-position hanger of FIG. 30 in the kick out orientation.
Figure 36:
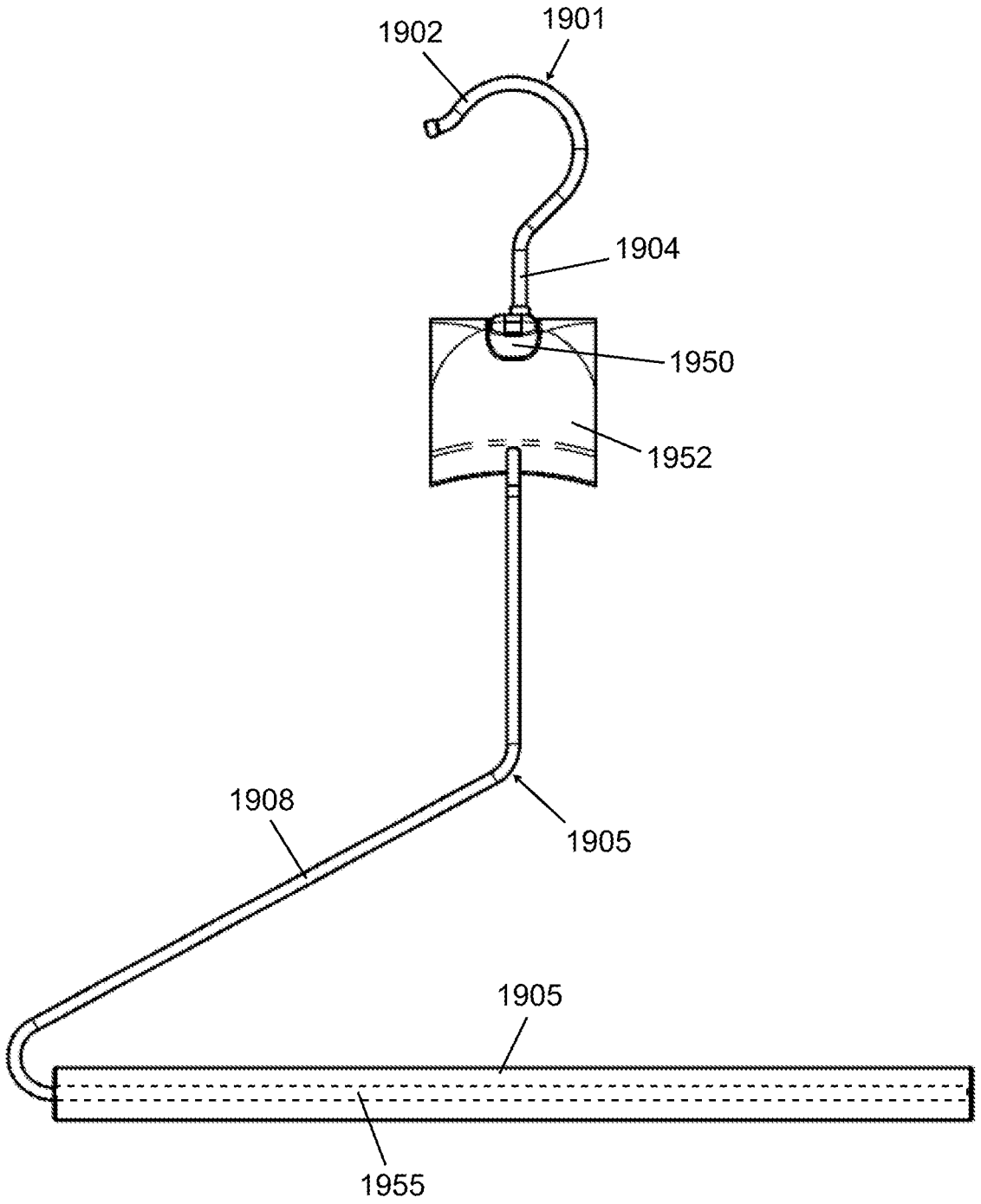
FIG. 36 is a front view of the multi-position hanger of FIG. 30 in the nested orientation with the wishbone thereof removed, according to an exemplary embodiment of present disclosure.
Figure 37:
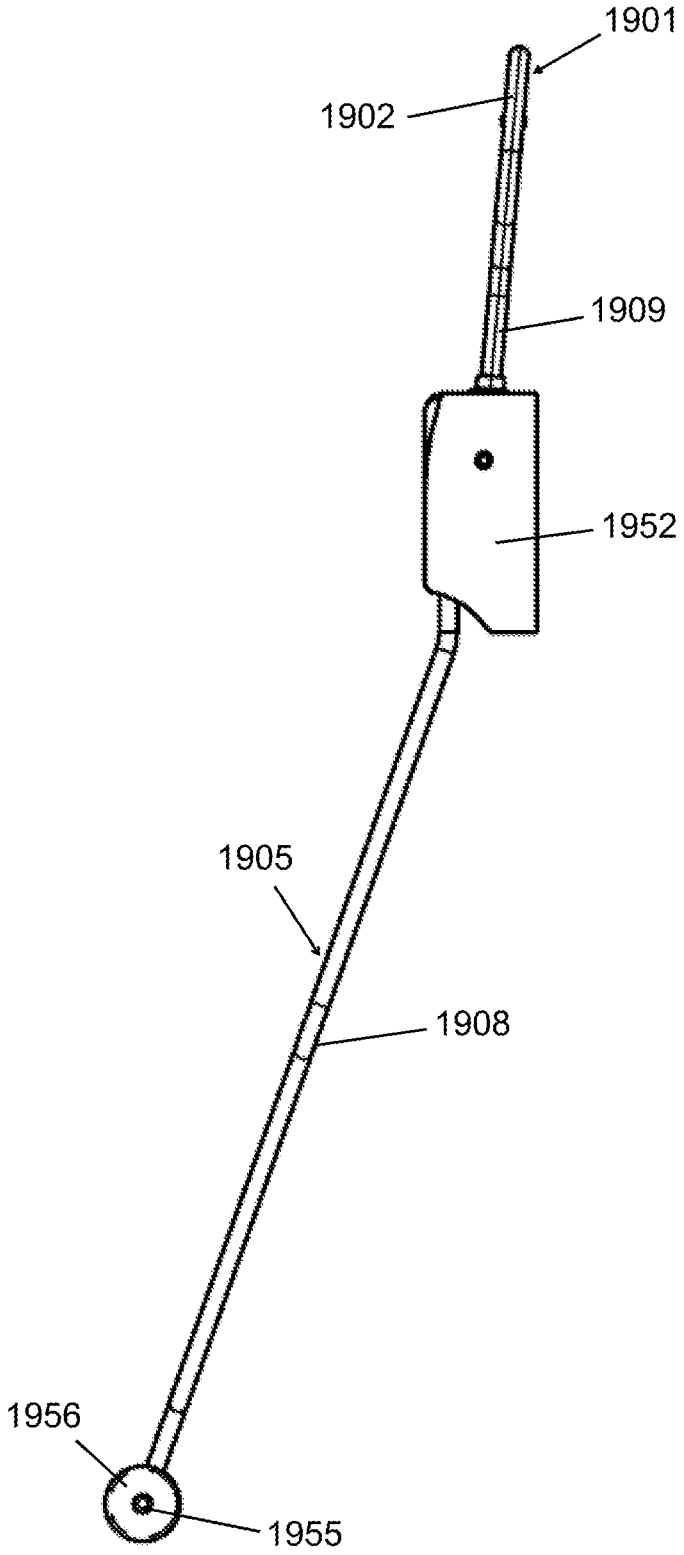
FIG. 37 is a side view of the multi-position hanger of FIG. 30 in the nested orientation with the wishbone thereof removed, according to an exemplary embodiment of present disclosure.
Figure 38:
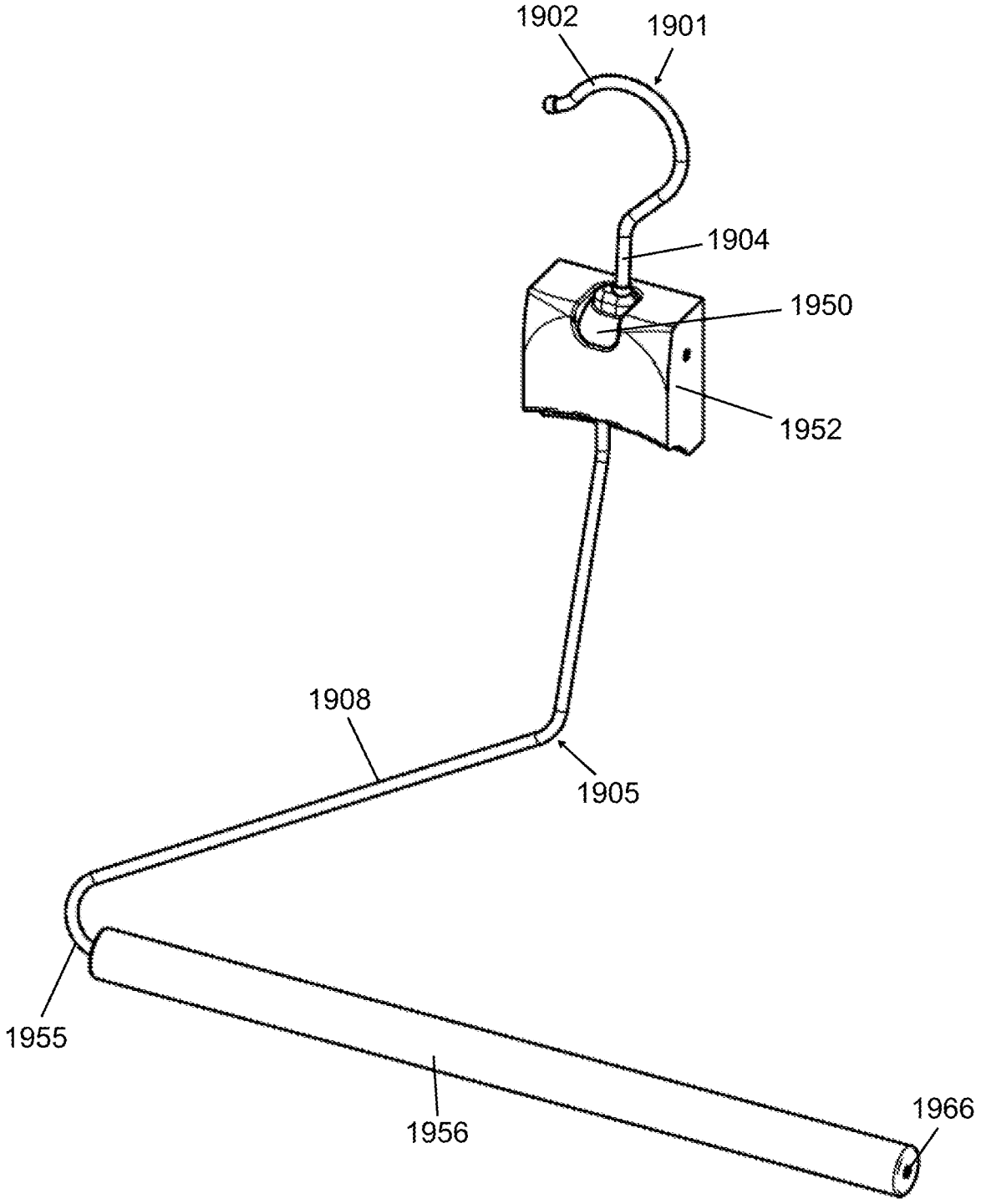
FIG. 38 is a front perspective view of the multi-position hanger of FIG. 30 in the nested orientation with the wishbone thereof removed, according to an exemplary embodiment of present disclosure.
Figure 39:
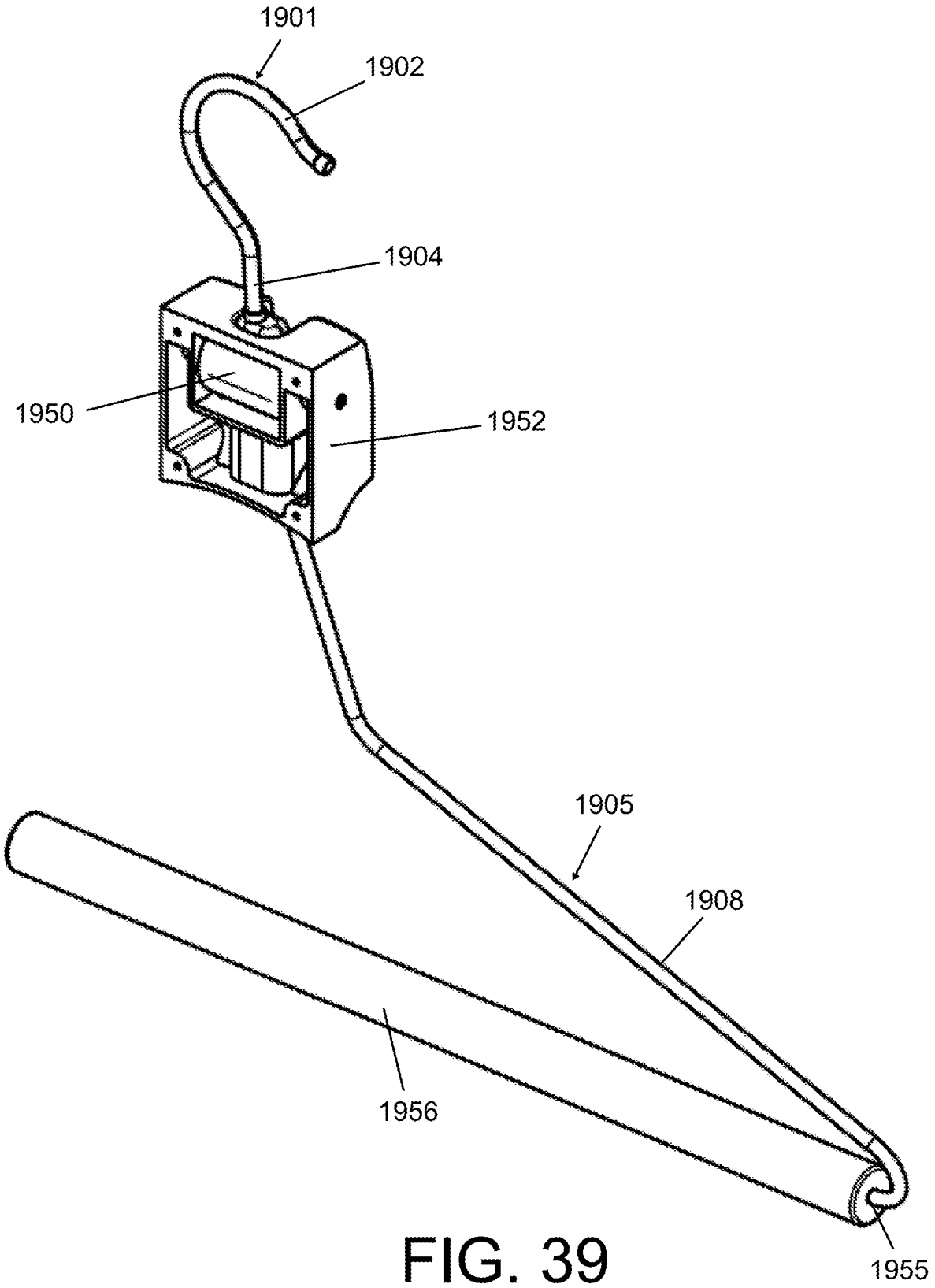
FIG. 39 is a rear perspective view of the multi-position hanger of FIG. 30 in the nested orientation with the wishbone thereof removed, according to an exemplary embodiment of present disclosure.

Another multi-position hanger 1900 that is rotatable between a nested position and at least one kick out position is shown in FIGS. 30-43. The multi-position hanger 1900 is similar to the multi-position hangers discussed above, and therefore the description above to like aspects or functions equally applies to that of hanger 1900. As shown in FIGS. 30-43, the hanger 1900 differs from the hangers discussed above in the adjustment mechanism between the stem portion 1904 of the hook member 1901 and the wishbone member 1920 that provides the adjustability between the nested position (see FIGS. 30-32) and the at least one kick-out position (see FIGS. 33-35).

As shown in FIGS. 30-43, the arm member 1905 is rigidly or fixedly attached to the wishbone 1920, and the stem portion 1904 of the hook member 1901 is pivotably and/or rotatably coupled to the wishbone 1920. As also shown in FIGS. 30-43 the stem portion 1904 of the hook member 1901 is coupled to a barrel or rotation member 1950 that is rotatably coupled to the wishbone 1920, such as within a housing or shroud 1952 that is coupled to the wishbone 1920. As shown in FIGS. 30-43, the housing 1952 may be at least partially positioned within a recess or cavity of the wishbone 1920, such that the barrel member 1950 is at least partially positioned within a recess or cavity of the wishbone 1920.

Figure 40:
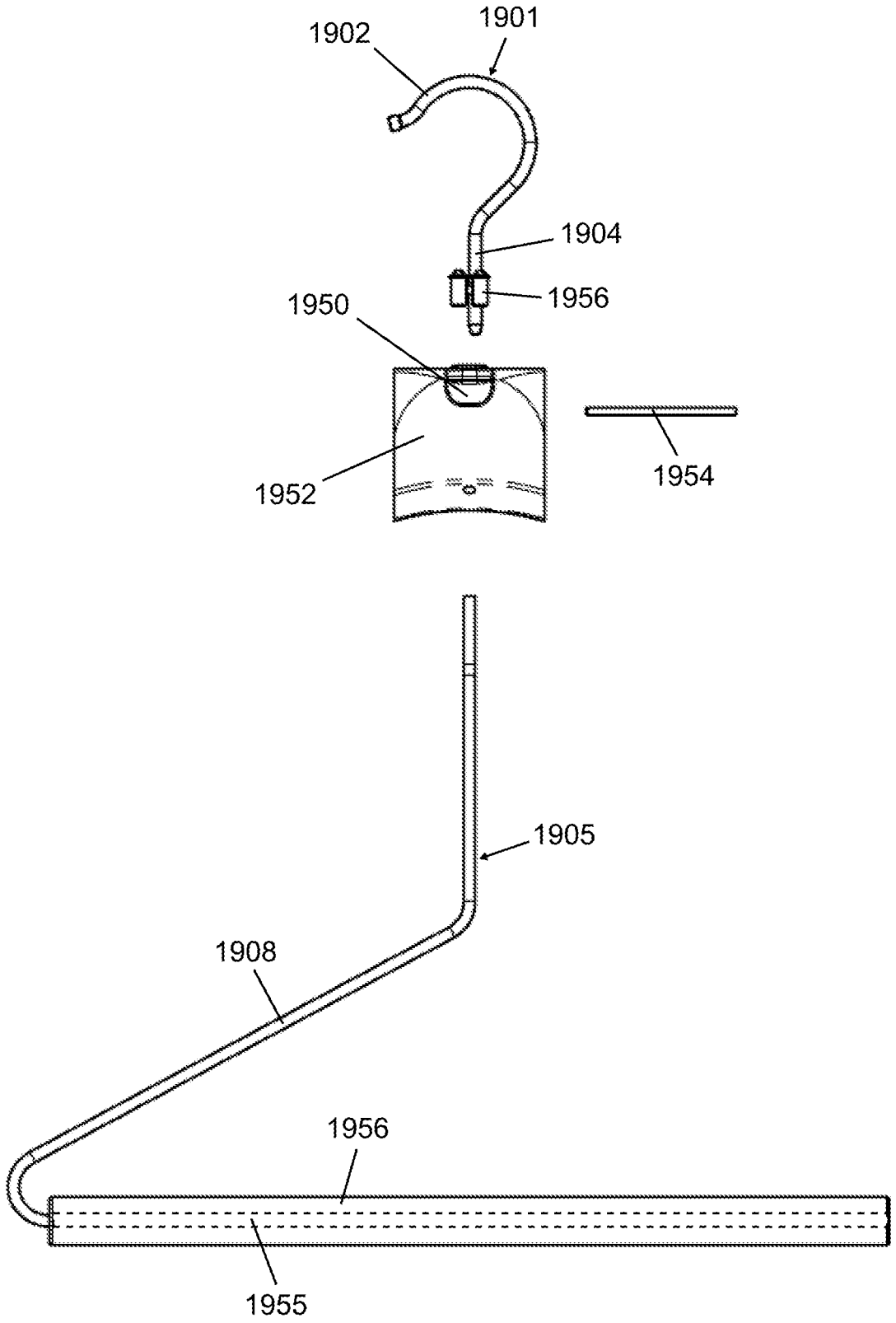
FIG. 40 is a front exploded view of the multi-position hanger of FIG. 30 with the wishbone thereof removed, according to an exemplary embodiment of present disclosure.
Figure 41:
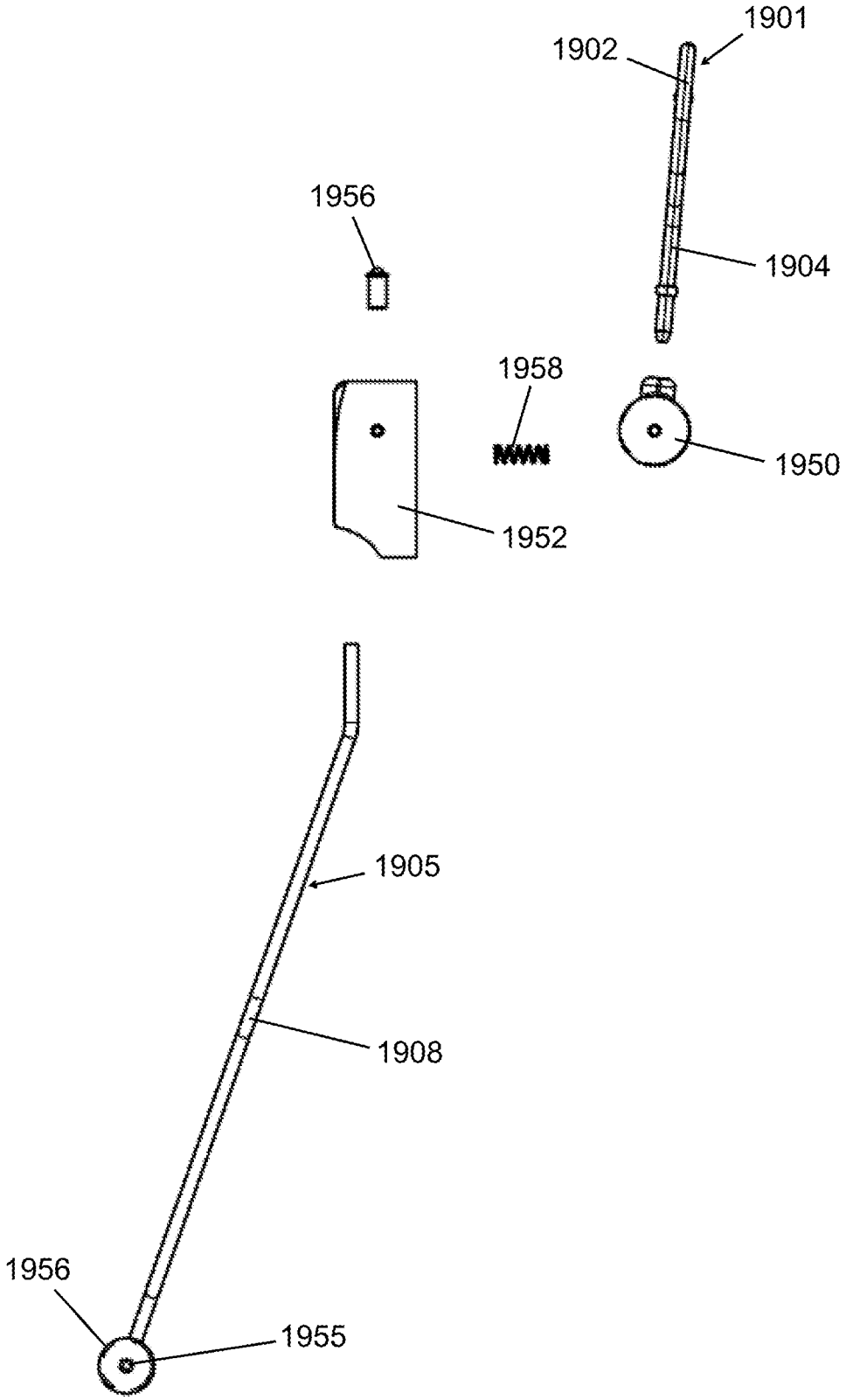
FIG. 41 is a side exploded view of the multi-position hanger of FIG. 30 with the wishbone thereof removed, according to an exemplary embodiment of present disclosure.
Figure 42:
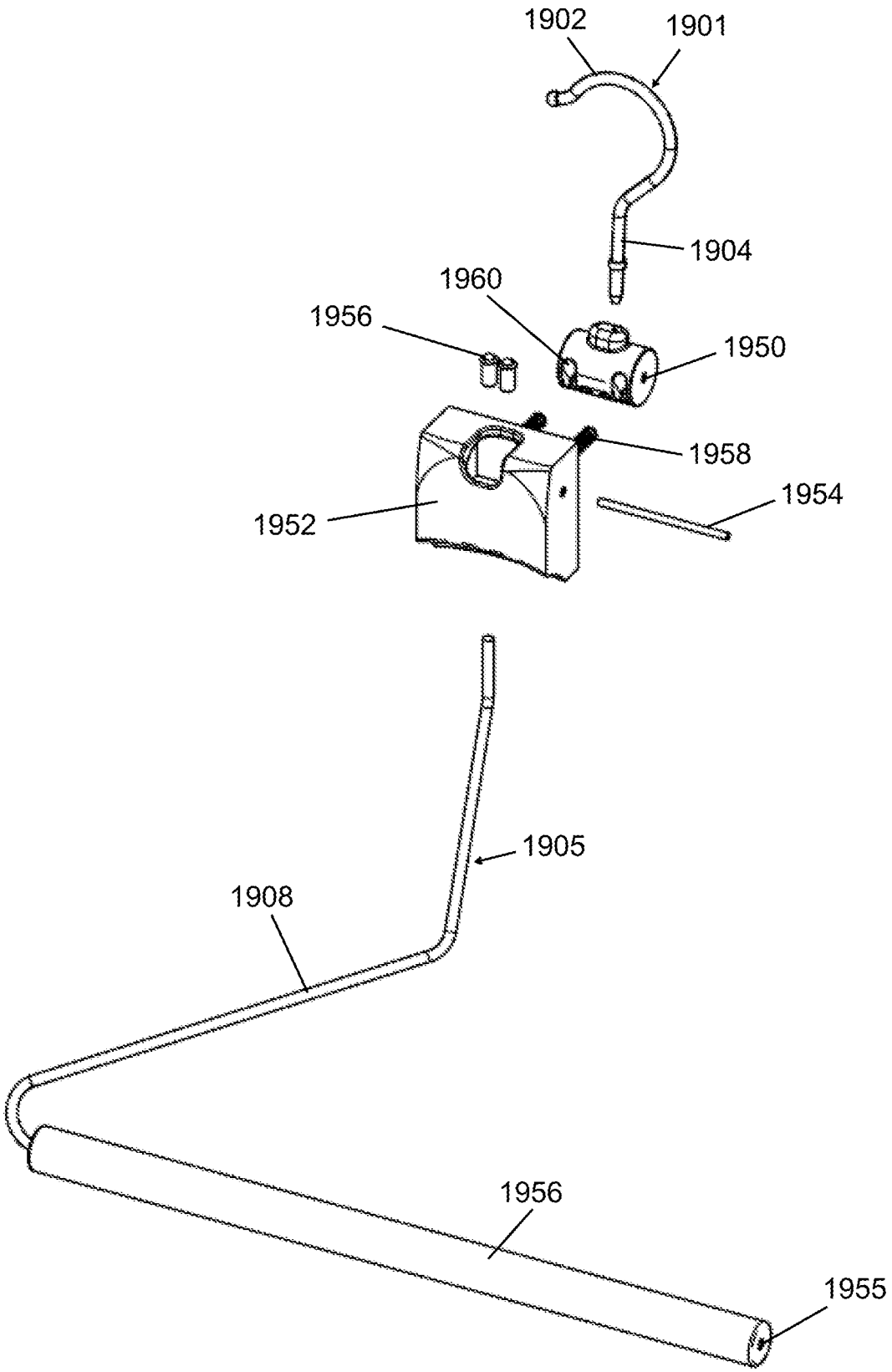
FIG. 42 is a front perspective view of the multi-position hanger of FIG. 30 with the wishbone thereof removed, according to an exemplary embodiment of present disclosure.
Figure 43:
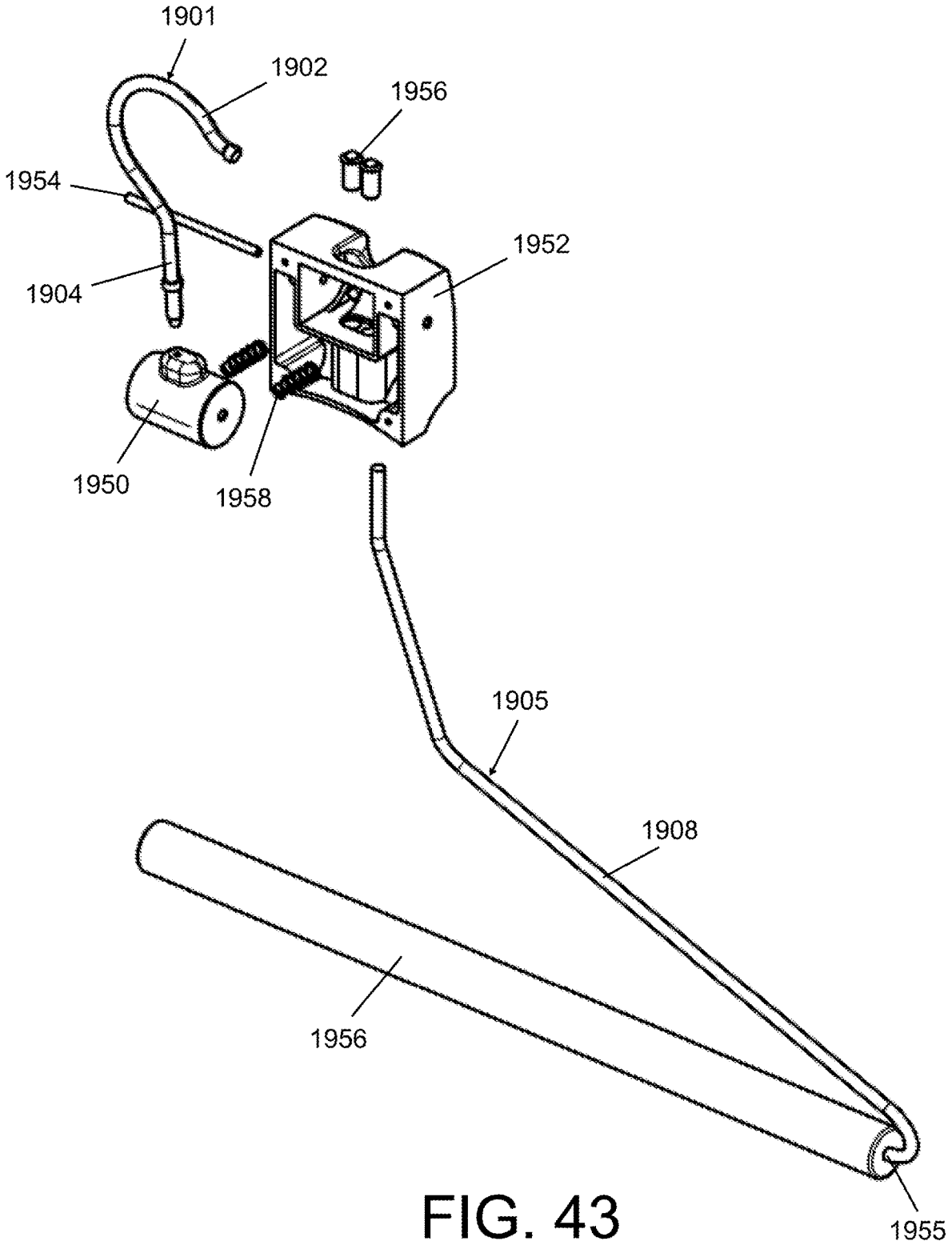
FIG. 43 is a rear perspective view of the multi-position hanger of FIG. 30 with the wishbone thereof removed, according to an exemplary embodiment of present disclosure.

The barrel member 1950 is arranged or oriented such that its axis of rotation extends in a longitudinal direction that extends along a direction between the opposing fee ends of the arms or shoulders of the wishbone 1920 and/or perpendicular to the lateral direction, as shown in FIGS. 39 and 41-43. The portions of the barrel member 1950 may thereby rotate or pivot in the lateral directions to provide the nested and kick out orientations, as described above. As shown in FIGS. 40, 42 and 43, the barrel member 1950 may rotate on an axle or pin member 1954 that is coupled to the housing 1952 and/or the wishbone 1920.

The stem portion 1904 of the hook member 1901 is coupled to the barrel member 1950 such that rotation of the barrel member 1950 about its axis of rotation rotates the hook member 1901 about the axis of rotation (i.e., laterally). The stem portion 1904 of the hook member 1901 may extend radially with respect to the barrel member 1950 and its axis of rotation. For example, the axis of the stem portion 1904 of the hook member 1901 may be oriented perpendicular (and potentially intersect) to the axis of rotation of the barrel member 1950. In some embodiments, the stem portion 1904 of the hook member 1901 is rotatably coupled to the barrel member 1950 about the axis of the stem portion 1904.

The opening or cavity of the wishbone 1920 and/or housing 1952 is configured to allow the barrel member 1950 and the stem portion 1904 of the hook member 1901 to rotate with respect to the wishbone 1920 about the axis of rotation of the barrel member 1950. As shown in FIGS. 41-43, the hanger 1900 may further include at least one resilient member 1958 (e.g., at least one spring) that engages a portion of the barrel member 1950 and biases the barrel member 1950 about its axis of rotation such that the hook member 1901 is biased into the nested orientation (or kick out orientation) (naturally or from the kick out orientation). The axis of the at least one resilient member 1958 (or the force applied thereby) is thereby angled to (e.g., perpendicular) and offset from the axis of rotation of the barrel member 1950 to force the barrel member 1950 about the axis of rotation thereof. In some embodiments, the barrel member 1950 may include at least one recess, flat or other corresponding exterior surface feature that is aligned with and engages the at least one resilient member 1958, as shown in FIGS. 41-43. The at least one resilient member 1958 may also extend into, and be partially housed within, at least one corresponding recess, flat or other corresponding interior surface feature of the housing 1952 and/or the wishbone 1920. The at least one resilient member 1958 may thereby be compressed between the barrel member 1950 and the housing 1952 and/or the wishbone 1920.

As also shown in FIGS. 40-43, the hanger 1900 may further include at least one spring pin, detent or the like mechanism 1956 (e.g., at least one spring) that engages an exterior portion of the barrel member 1950 to selectively retain the barrel member 1950 in a particular orientation or angular position about its axis of rotation, such as in the kick out orientation (and/or the nested orientation). The at least one detent mechanism 1956 may define an axis (or the force applied thereby) is thereby angled to (e.g., perpendicular) that is offset from and angled to (e.g., perpendicular) the axis of rotation of the barrel member 1950. In some embodiments, the barrel member 1950 may include at least one recess, flat or other corresponding exterior surface feature that is aligned with and engages the at least one detent mechanism 1956, as shown in FIG. 42. The at least one detent mechanism 1956 may also extend into, and be partially housed within, at least one corresponding recess, flat or other corresponding interior surface feature of the housing 1952 and/or the wishbone 1920. The at least one detent mechanism 1956 may thereby be compressed or forced between the barrel member 1950 and the housing 1952 and/or the wishbone 1920 to provide friction against the barrel member 1950 to inhibit rotation of the barrel member 1950 about its axis of rotation and, thereby, selectively retain the hook member 1901 coupled to the barrel member 1950 in the kick out orientation (and/or the nested orientation).

Figure 44:
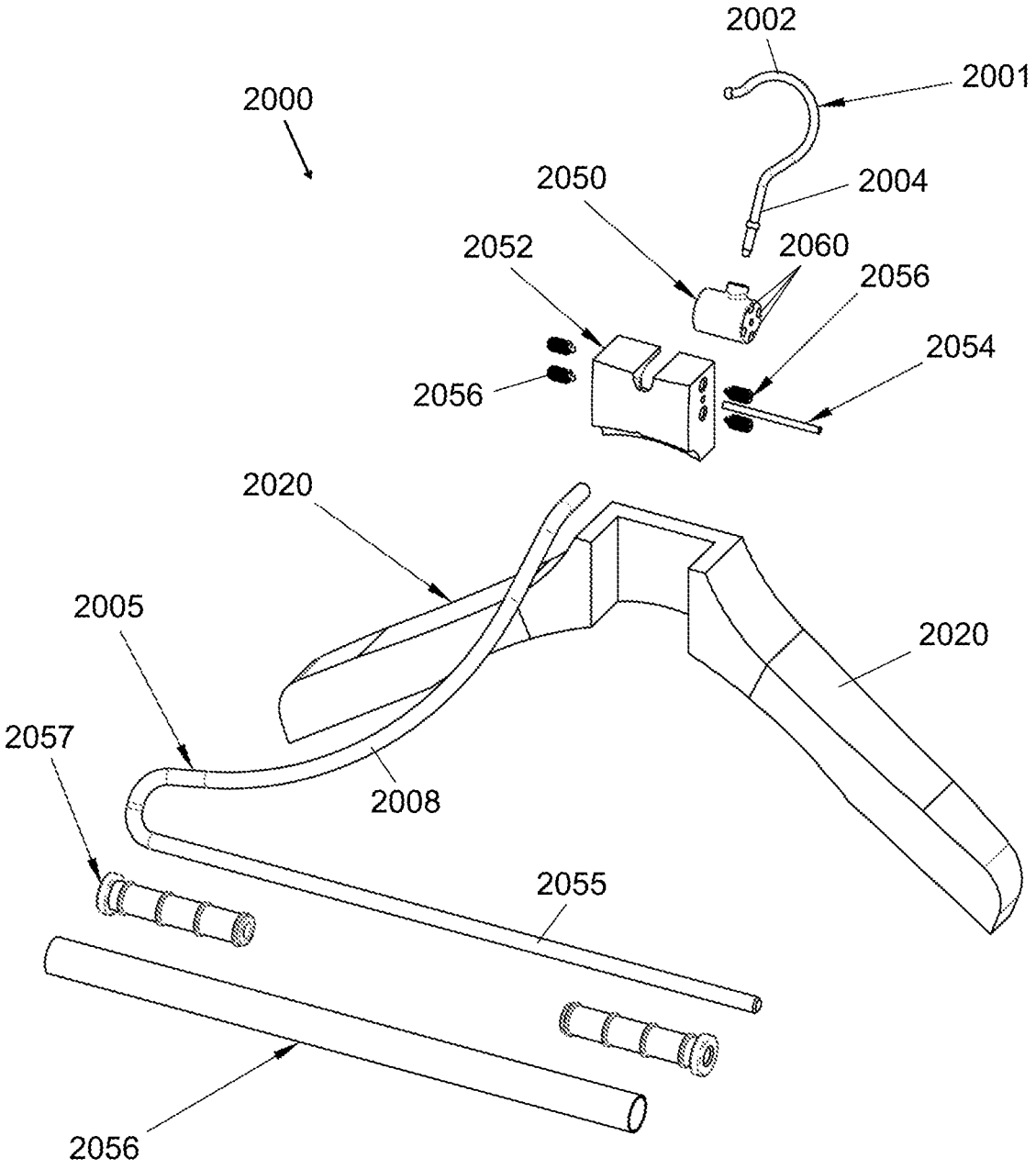
FIG. 44 is a front exploded view of a multi-position hanger, according to an exemplary embodiment of present disclosure.
Figure 45:
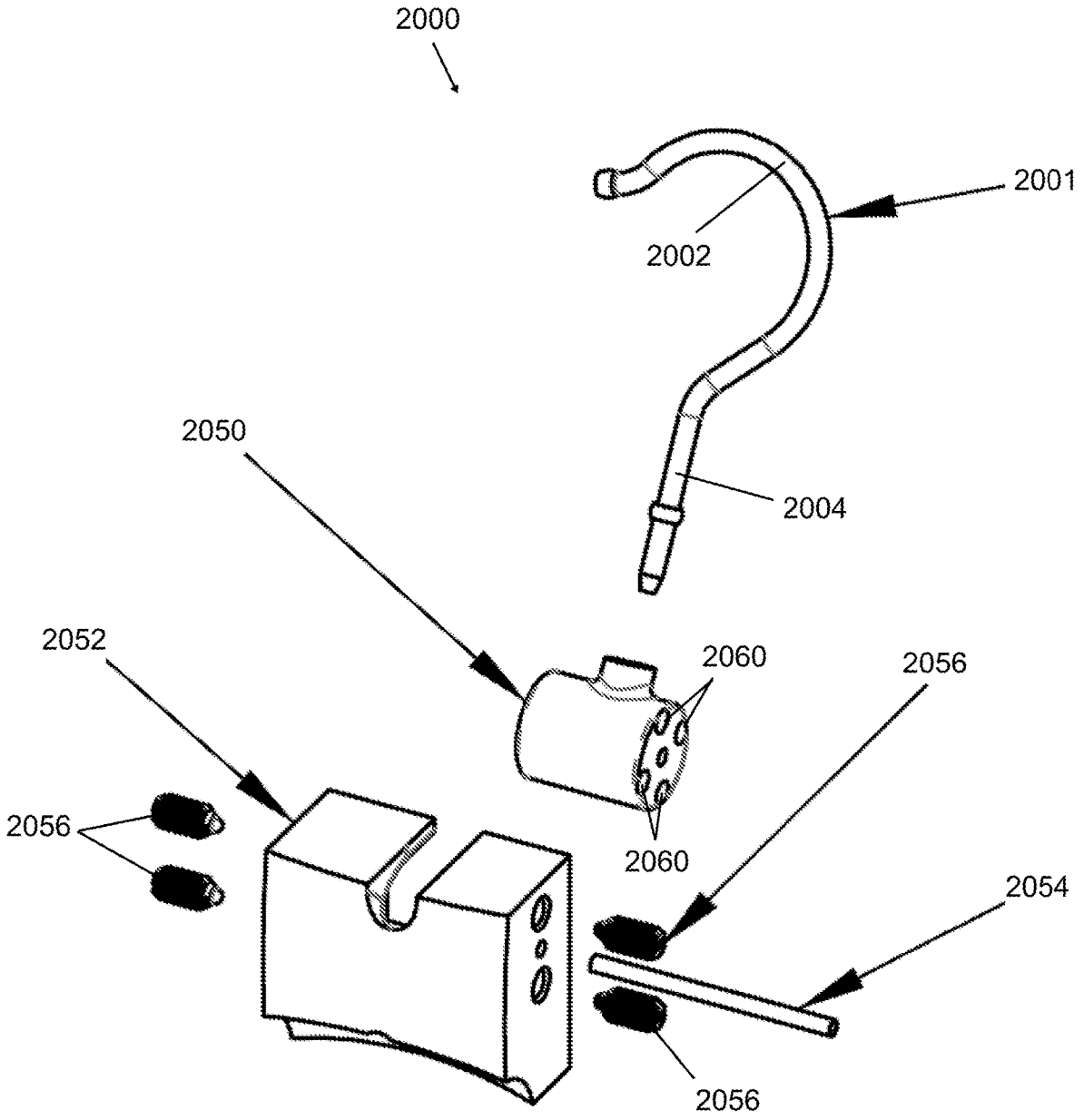
FIG. 45 is a front perspective exploded view of a hook member and an adjustment mechanism of the multi-position hanger of FIG. 44, according to an exemplary embodiment of present disclosure.
Figure 46:
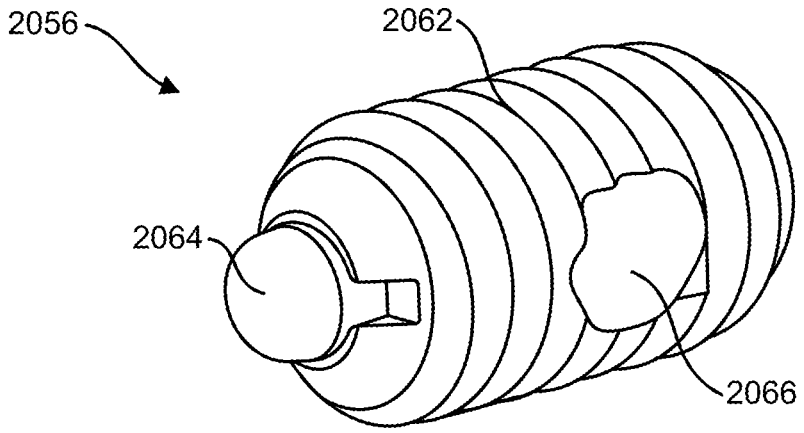
FIG. 46 is a perspective view of a retention member of the multi-position hanger of FIG. 44, according to an exemplary embodiment of present disclosure.

Another multi-position hanger 2000 that is rotatable between a nested position and at least one kick out position is shown in FIGS. 44-46. The multi-position hanger 2000 is similar to the multi-position hangers discussed above, and therefore the description above to like aspects or functions equally applies to that of hanger 2000. As shown in FIGS. 44-46, the hanger 2000 differs from the hangers discussed above in the adjustment mechanism between the stem portion 2004 of the hook member 2001 and the wishbone member 2020 that provides the adjustability between the nested position and the at least one kick-out position, as described above.

The multi-position hanger 2000 is substantially similar to the multi-position hanger 1900 described above and shown in 30-43, but differs in that it includes at least one detent mechanism 2056 that is oriented such that is engages an outer end of the barrel member 2050 and defines an axis that is aligned with and offset from the axis of rotation of the barrel member 2050, as shown in FIGS. 44 and 45. Specifically, as shown in FIGS. 44 and 45, the hanger 2000 includes a plurality of detent mechanisms 2056 that are circumferentially spaced about the axis of rotation of the barrel member 2050 that selectively engage recesses that are likewise circumferentially spaced about the axis of rotation of the barrel member 2050 depending upon the angular or rotational position of the barrel member 2050. The plurality of recesses in the end(s) of the barrel member 2050 and the plurality of detent mechanisms 2056 are configured (e.g., orientation and arranged) such that they correspond to the nested orientation, the kick out orientation, and at least one orientation therebetween.

As shown in FIG. 46, in some embodiments, the at least one detent mechanism 2056 comprises a nose spring plunger that comprises external threads 2062 that threadably engage apertures of the housing 2052 and/or wishbone 2020, a spring-loaded detent member 2064 (e.g., ball detent) at the tip or end thereof. As also shown in FIG. 46, the at least one detent mechanism 2056 may include a radial thread locking member 2066 that inhibits rotation of the detent mechanism 2056 within the aperture of the housing 2052 and/or wishbone 2020.

Further, the multi-position hanger 2000 is void of one or more resilient members that bias the barrel member 2050, and thereby the hook member 2001 coupled thereto, into the nested or kick out position.

In some other multi-position hangers of the present disclosure (not shown), the barrel member is configured as a ratchet wheel with a plurality of teeth (or other circumferentially arranged and spased projections/indentations) about the barrel member (i.e., about the axis of rotation of the barrel member). The hanger may further include a pivotable or rotatable pawl member that naturally or neutrally selectively engages the teeth of the ratchet wheel and prevents rotation of the in a first angular or rotational direction about the axis of rotation. The pawl member may be exposed or accessible by a user at or from the exterior of the housing, wishbone or other portion of the hanger such that the pawl member can be manually repositioned away from the ratchet wheel to allow the ratchet wheel to rotate in the first angular or rotational direction about the axis of rotation. The ratchet wheel and pawl member may be configured such that the hook portion coupled to the ratchet wheel is naturally or neutrally retained in a kick out orientation by the pawl member and prevented from rotation to or toward nested orientation. In this way, the hook member and/or pants par/wishbone can be manually positioned in the kick out orientation and retained therein by the pawl member, and then the pawl member can be engaged and moved away from the ratchet member to allow the hook member to naturally rotate into the nested orientation.

Figure 47:
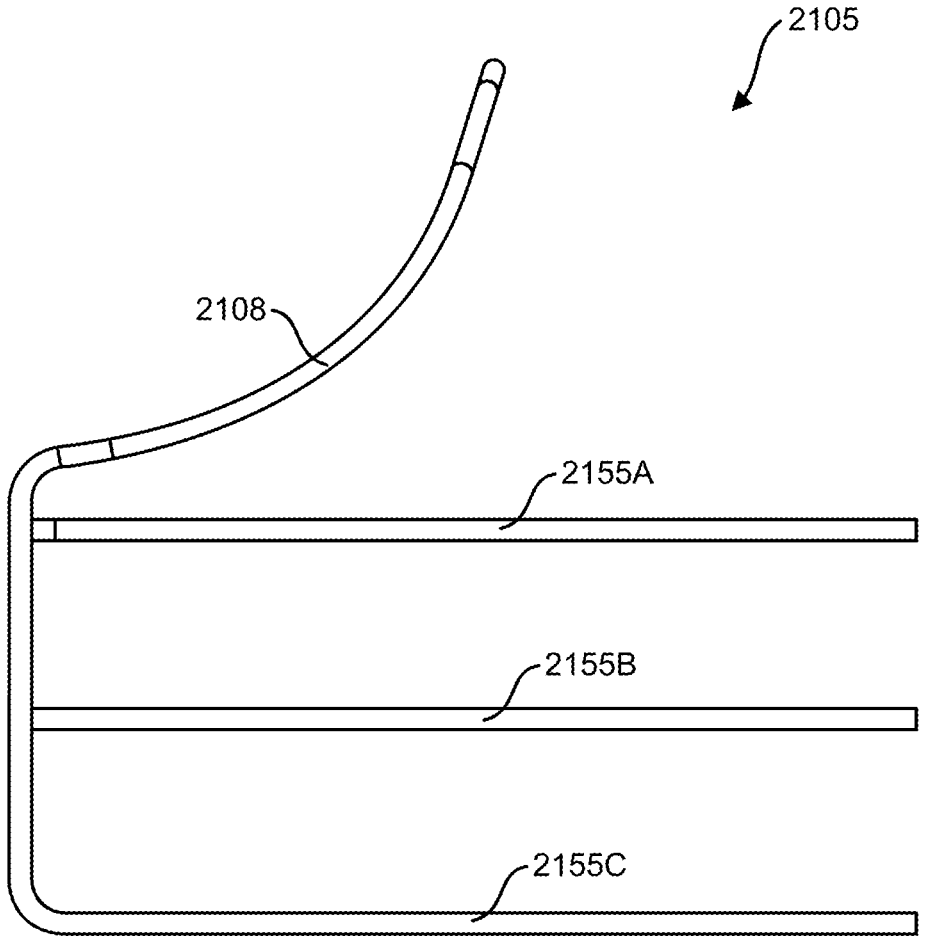
FIG. 47 is a front view of an arm member with a plurality of spaced of pants bars, according to an exemplary embodiment of present disclosure.

FIG. 47 illustrates an exemplary arm member 2105 that may be utilized with a multi-position hanger of the present disclosure. As shown in FIG. 47, the arm member 2105 includes an arced, offset, swoosh and/or connector portion 2108 that extends at least partially (or fully) between a wishbone and a plurality of spaced pants bar portions 2155A, 2155B, 2155C . . . 2155Z. Although three pants bars 2155A, 2155B, 2155C are illustrated, the arm member 2105 may include two pants bars 2155A, 2155B or more than three pants bars 2155A, 2155B, 2155C . . . 2155Z. As shown in FIG. 46, the pants bars 2155A, 2155B, 2155C . . . 2155Z may spaced along the vertical direction such that the second pants par 2155 is positioned below the first pants bar 2155A when the hanger is hung on a support. Each pants bars 2155A, 2155B, 2155C . . . 2155Z may extend from a portion of the arm member 2105 and define a free end, as shown in FIG. 47. The plurality of pants bars 2155A, 2155B, 2155C . . . 2155Z may thereby allow a plurality of pants to be held by the hanger (i.e., each pants bars 2155A, 2155B, 2155C . . . 2155Z can be utilized to hang a pair of pants thereon).

As described above, when the hanger incorporating the arm member 2105 is in the nested orientation, the pants bars 2155A, 2155B, 2155C . . . 2155Z may be vertically aligned (and/or laterally aligned with each other), and potentially laterally aligned with the centerline of the hanger and/or wishbone. In some other embodiments, when the hanger incorporating the arm member 2105 is in the nested orientation, the pants bars 2155A, 2155B, 2155C . . . 2155Z may angled in a lateral direction such that the pants bars 2155A, 2155B, 2155C . . . 2155Z are spaced from each other in the lateral direction and laterally spaced differently from the centerline of the hanger and/or wishbone. When the hanger incorporating the arm member 2105 is in the kick out orientation, the pants bars 2155A, 2155B, 2155C . . . 2155Z are spaced from each other in the lateral direction (to a greater extent than in the nested orientation, if laterally spaced) and laterally spaced differently from the centerline of the hanger and/or wishbone (but to a greater extent than in the nested orientation, if laterally spaced).

It is to be understood that the above description is intended to be illustrative, and not restrictive. For example, the above-described examples (and/or aspects thereof) may be used in combination with each other. In addition, many modifications may be made to adapt a particular situation or material to the teachings of the various examples without departing from their scope. While dimensions and types of materials may be described herein, they are intended to define parameters of some of the various examples, and they are by no means limiting to all examples and are merely exemplary. Many other examples will be apparent to those of skill in the art upon reviewing the above description. The scope of the various examples should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as referee labels, and are not intended to impose numerical, structural or other requirements on their objects. Forms of term "based on" herein encompass relationships where an element is partially based on as well as relationships where an element is entirely based on. Forms of the term "defined" encompass relationships where an element is partially defined as well as relationships where an element is entirely defined. Further, the limitations of the following claims are not written in means-plus-function format and are not intended to be interpreted based on 35 U.S.C. § 112, sixth paragraph, unless and until such claim limitations expressly use the phrase "means for" followed by a statement of function cavity of further structure. It is to be understood that not necessarily all such objects or advantages described above may be achieved in accordance with any particular example. Thus, for example, those skilled in the art will recognize that the devices, systems and methods described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of examples, it should be readily understood that the disclosure is not limited to such disclosed examples. Rather, this disclosure can be modified to incorporate any number of variations, alterations, substitutions or equivalent arrangements not heretofore described, but which are commensurate with the spirit and scope of the disclosure. Additionally, while various examples have been described, it is to be understood that aspects of the disclosure may include only one example or some of the described examples. Also, while some disclosure are described as having a certain number of elements, it will be understood that the examples can be practiced with less than or greater than the certain number of elements.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

What is claimed:

1. A multi-position hanger comprising:

a hook member comprising a hook portion and a stem portion;

a wishbone rotatably attached to the stem portion of the hook member, the wishbone comprising a first arm that extends longitudinally and defines a first free end, an opposing second arm that extends longitudinally and defines a second free end, and a shaped slot that defines and extends along a pathway between a first slot end surface that is positioned proximate to a first lateral face of the wishbone and a second slot end surface that is positioned proximate to a second lateral face of the wishbone; and a pants bar rigidly attached to the wishbone positioned below the wishbone and defining a free end, wherein the pathway of the shaped slot is hooked-shaped such that it extends both laterally and longitudinally, and the first and second slot end surfaces are laterally spaced apart and both face towards the first lateral face of the wishbone, wherein the stem portion of the hook member extends through and is translatable throughout the shaped slot of the wishbone, and wherein the wishbone and the pants bar are selectively repositionable with respect to the hook member when the hook portion hangs on a support between a kick out orientation of the hanger with the pants bar positioned at a first lateral position with respect to a reference line extending vertically downward from the wishbone and the stem portion being positioned against the first slot end surface and spaced from the second slot end surface of the shaped slot to retain the kick out orientation, and a nested orientation of the hanger with the pants bar positioned at a second lateral position with respect to the reference line and the stem portion being positioned against the second slot end surface and spaced from the first slot end surface of the shaped slot to retain the nested orientation, the first and second lateral positions being differing lateral positions with respect to the reference line.

2. The multi-position hanger of claim 1, wherein the wishbone is positioned fully below the hook portion of the hook member when the pants bar is in the kick out and nested orientations.

3. The multi-position hanger of claim 1, wherein the wishbone and the pants bar are rotatable about an axis of the stem portion of the hook member.

4. The multi-position hanger of claim 3, wherein the wishbone and the pants bar are angularly adjustable with respect to the axis of the stem portion of the hook member.

5. The multi-position hanger of claim 1, wherein the stem portion comprises a spherical end portion, and wherein the wishbone comprises a socket portion, the spherical end portion and the socket portion being rotatably coupled together and forming a ball-and-socket joint.

6. The multi-position hanger of claim 1, wherein the stem portion and the wishbone are rotatably within an interior cavity of the wishbone beneath the shaped slot.

7. The multi-position hanger of claim 1, wherein the stem portion and the wishbone are rotatably coupled below the hooked-shaped slot.

8. The multi-position hanger of claim 1, wherein the first end surface of the hooked-shaped slot is positioned proximate to a first lateral side and distal to second lateral side of the wishbone, and the second end surface of the hooked-shaped slot is positioned proximate to the second lateral side and distal to first lateral side of the wishbone.

9. The multi-position hanger of claim 1, wherein the hooked-shaped slot comprises a linear portion that extends along the lateral direction from the second end surface thereof, and an arcuate portion that extends from the first end surface thereof to the linear portion.

10. The multi-position hanger of claim 9, wherein the arcuate portion extends laterally and along a longitudinal direction that extends between the first and second free ends of the wishbone.

11. The multi-position hanger of claim 1, wherein the second lateral position of the pants bar is laterally aligned with the reference line.

12. The multi-position hanger of claim 1, wherein the second lateral position of the pants bar is laterally spaced from the reference line.

13. The multi-position hanger of claim 1, wherein the pants bar extends linearly.

14. The multi-position hanger of claim 1, further comprising a sleeve extending over the pants bar.

15. The multi-position hanger of claim 1, further comprising an offset bar that extends between the wishbone and an end of the pants bar that opposes the free end thereof.

16. The multi-position hanger of claim 1, wherein a first lateral side of the hook member and the pants bar form a first angle therebetween, and wherein the first angle is smaller in the kick out orientation of the hanger than in the nested orientation of the hanger.

17. The multi-position hanger of claim 1, wherein a first lateral side of the hook member and the wishbone form a first angle therebetween, and wherein the first angle is smaller in the kick out orientation of the hanger than in the nested orientation of the hanger.

18. The multi-position hanger of claim 1, wherein the stem portion extends linearly.

19. The multi-position hanger of claim 1, further comprising at least one secondary pants bar fixedly coupled to and positioned below the pants bar.

* * * * *